US009347163B2

(12) United States Patent
Sakuma et al.

(10) Patent No.: US 9,347,163 B2
(45) Date of Patent: May 24, 2016

(54) GAS CARRYING THREADING DEVICE OF SEWING MACHINE

(71) Applicant: SUZUKI MANUFACTURING, LTD., Yamagata (JP)

(72) Inventors: Tohru Sakuma, Yamagata (JP); Masato Ishikawa, Yamagata (JP)

(73) Assignee: SUZUKI MANUFACTURING, LTD., Yamagata (JP)

( * ) Notice: Subject to any disclaimer, the term of this patent is extended or adjusted under 35 U.S.C. 154(b) by 0 days.

(21) Appl. No.: 14/406,815

(22) PCT Filed: Oct. 26, 2012

(86) PCT No.: PCT/JP2012/077737

§ 371 (c)(1),
(2) Date: Dec. 10, 2014

(87) PCT Pub. No.: WO2014/010108

PCT Pub. Date: Jan. 16, 2014

(65) Prior Publication Data

US 2015/0167218 A1 Jun. 18, 2015

(30) Foreign Application Priority Data

Jul. 13, 2012 (JP) ..... 2012-157671

(51) Int. Cl.

| | |
|---|---|
| ***D05B 63/00*** | (2006.01) |
| ***D05B 57/02*** | (2006.01) |
| ***D05B 87/00*** | (2006.01) |

(Continued)

(52) U.S. Cl.

CPC *D05B 63/00* (2013.01); *D05B 1/10* (2013.01); *D05B 57/02* (2013.01); *D05B 87/00* (2013.01); *D05B 87/02* (2013.01)

(58) Field of Classification Search

CPC ..... D05B 1/20; D05B 57/00; D05B 57/02; D05B 57/06; D05B 57/08; D05B 57/10; D05B 57/12; D05B 63/00; D05B 87/00; D05B 87/02; D05B 1/10

See application file for complete search history.

(56) References Cited

U.S. PATENT DOCUMENTS 4,267,786 A * 5/1981 Hanyu ..... D05B 1/12 112/163
4,967,677 A * 11/1990 Seiriki ..... D05B 1/12 112/162

(Continued)

FOREIGN PATENT DOCUMENTS

JP S436191 Y1 3/1968
JP 527353 4/1993

(Continued)

*Primary Examiner* — Ismael Izaguirre
(74) *Attorney, Agent, or Firm* — Bacon & Thomas, PLLC

(57) ABSTRACT

An engaging clutch for respectively transmitting power from a sewing machine motor to a drive shaft driving a stitch forming device including the looper at the time of the stitch formation or to the gas supply source at the time of the looper threading comprises a structure which is moved to one of a gas supply drive member which transmits the power to the gas supply source and a stitch forming drive member which is fastened to one end of the drive shaft and transmits the power to the stitch forming device so that approach/separation becomes free depending on a manual operation of a looper threading/stitch forming changeover manual operating portion and transmits the power from the sewing machine motor through a clutch hollow shaft and retains a connecting state when connecting to the gas supply drive member.

9 Claims, 17 Drawing Sheets

(51) Int. Cl.
*D05B 1/10* (2006.01)
*D05B 87/02* (2006.01)

(56) References Cited

U.S. PATENT DOCUMENTS 5,327,841 A * 7/1994 Sakuma ..... D05B 87/00 112/162
5,862,766 A * 1/1999 Fung ..... D05B 1/12 112/155
2002/0017227 A1* 2/2002 Ochi ..... D05B 3/02 112/197
2008/0134950 A1* 6/2008 Sadasue ..... D05B 1/10 112/201
2008/0236466 A1* 10/2008 Sadasue ..... D05B 57/30 112/302
2008/0257241 A1* 10/2008 Sadasue ..... D05B 81/00 112/225

FOREIGN PATENT DOCUMENTS

JP 2865470 B2 12/1998
JP 3355214 B2 9/2002
JP 2005-308142 A 11/2005
JP 4088504 B2 2/2008
JP 2008-119361 A 5/2008
JP 4741701 B2 5/2011
WO WO2011021325 A1 * 2/2011

* cited by examiner

GAS CARRYING THREADING DEVICE OF SEWING MACHINE

FIELD OF THE ART

The present invention relates to a gas carrying threading device of sewing machine, particularly relates to the gas carrying threading device of sewing machine such as a serger, a double chain stitch sewing machine, or a cover stitch sewing machine for performing a threading of a looper thread automatically to a looper by utilizing a pressurized gas.

BACKGROUND OF THE ART

Conventionally, in the serger, the double chain stitch sewing machine, or the cover stitch sewing machine, etc., the gas carrying threading device which is connected by a hollow looper thread guide which leads to a looper thread guide outlet of a loop-taker point of the looper from a looper thread introduction mechanism which inserts the looper thread and which feeds a looper thread by utilizing a flow of a pressurized gas which is supplied to the hollow looper thread guide is known. Hereby, a complicated thread guard is unnecessary and a threading that a handleability is easy can be performed. Therefore, there are no mistake of the threading, no protrusion of the looper thread in mid-process, and no entanglement of the inserted looper thread with other thread, and thereby the threading can be performed at once by the extremely easy operation (Patent document No. 1-No. 3).

In a structure of the foregoing gas carrying threading, a pathway for the threading becomes considerably simple, and an operation of the threading becomes easy, and an entanglement of the thread or an incidence of a thread breakage can be dissolved.

However, in the structure of the foregoing gas carrying threading, while pressing a stopper shaft (positioning pin) for a stop positioning circular plate by one hand, a pulley is rotated manually by the other hand, and thereby a stitch forming device must be locked and concurrently a threading connecting device must be connected. Therefore, it is difficult to understand how to use this threading device for the operator who is not familiar with the sewing machine, and an insertion operation of the looper thread which is performed by using both hands concurrently is considerably complex, thereby the training of that purpose is necessary.

Then, a looper threading device which inserts the looper thread to the looper by several operations by one hand without using both hands concurrently and attempts an easy threading operation is proposed (Patent document No. 4-No. 5).

PRIOR ART DOCUMENT

Patent Document

[Patent document No. 1] JP-2865470-B2
[Patent document No. 2] JP-3355214-B2
[Patent document No. 3] JP-40813504-B2
[Patent document No. 4] JP-2008-119361-A
[Patent document No. 5] JP-4741701-B

SUMMARY OF THE INVENTION

Problem to be Solved by the Invention

In the looper threading device which is disclosed in Patent Document No. 5, because the looper thread can be inserted to the looper by one-handed operation of only three times by using a looper threading/stitch forming change over manual lever, it is very efficient as the looper threading device. However, there is a disadvantage that a safety device for avoiding transition to a stitch forming state from a looper threading state during a gas supply operation of a gas supply pump is required.

Besides, although the looper threading device (FIG. 2) which is disclosed in Patent Document No. 4 performs the threading of the looper by using the structure of a push button which is disclosed in Patent Document No. 1-No. 2 unlike the looper threading device which is disclosed in Patent Document No. 5, there are following serious disadvantages.

(1) As the disadvantage in the mechanism, (a) Because a looper (looper support member), a looper drive arm and a thread pass tube looper thread guide plate are composed as a conglomerate which gather separately, a looper drive at the time of sewing and a changeover mechanism at the time of looper threading become complicated (FIG. 3).

(b) Because a looper take-up lever does not intervene in a looper threading route to a thread insertion opening from a thread groove, it is necessary to consider a looper take-up lever mechanism separately (FIG. 1, FIG. 5, FIG. 13).

(2) As the disadvantage in the operation, (a) Essentially, the looper threading is intended to perform the threading of the looper thread which is drawn out from a thread spool to a looper loop-taker point thread outlet directly. However originally, the operation which guides the looper thread which is drawn out from the thread spool from the thread groove to the thread insertion opening is extremely complicated in the looper threading device which is disclosed in Patent Document No. 4 (FIG. 1).

(b) The looper threading device which is disclosed in Patent Document No. 4 is intended to attempt the easy operation of the threading because the threading operation is considerably simplified. However, practically, one-handed operation of four times of an operation for movement of operation lever, an operation for rotation of positioning of flywheel, a pressing operation of a lock button and an operation for starting of air spraying are indeed necessary. Therefore, the effect that the threading operation is considerably simplified and the easy operation of the threading is attempted cannot be achieved. Further, heretofore, a problem to have to insert directly a tip of a lower thread to the thread insertion opening of the looper which is assumed to be complicated remains (FIG. 1, FIG. 13).

The present invention was conducted to solve these disadvantages. The object of the present invention is to provide the gas carrying threading device of sewing machine that the safety device for avoiding the transition to the stitch forming state from the looper threading state during the gas supply operation of the gas supply pump is not required and is simplified on the mechanism and is able to perform the threading more easily with one-touch operation to the looper by one-handed operation of small number of times on the operation.

Besides, the object of the present invention is to provide the gas carrying threading device of sewing machine which is able to perform the threading with one-touch operation to the looper because the pressurized gas for supplying the looper thread by the gas is produced by the gas supply pump which operates by changing over a sewing machine motor which drives the stitch forming device.

Further, the object of the present invention is to provide the gas carrying threading device of sewing machine which is able to perform a looper threading changeover operation by one-handed operation by a looper threading/stitch forming changeover mechanism.

Means for Solving the Problems

In order to achieve such the objects, a gas carrying threading device of sewing machine of the present invention comprises at least one looper having a hollow structure from a looper thread inlet to a looper loop-taker point thread outlet, a looper thread introduction mechanism inserting a looper thread which is led to the looper, a hollow looper thread guide extending from the looper thread introduction mechanism to the looper thread inlet and having a looper thread guide outlet, a gas supply source that a looper threading of the looper thread is performed from the looper thread introduction mechanism to the looper thread guide outlet through the hollow looper thread guide by the gas carrying, a clutch for respectively transmitting power from the sewing machine motor to a drive shaft driving a stitch forming device including the looper at the time of the stitch formation or to the gas supply source at the time of the looper threading, and a looper threading/stitch forming changeover mechanism for changing over the clutch so that the transmission of the power to the stitch forming device is interrupted and the power is transmitted to the gas supply source at the time of the looper threading and so that the power is transmitted to the stitch forming device and the transmission of the power to the gas supply source is interrupted at the time of the stitch formation depending on a manual operation of a looper threading/stitch forming changeover manual operating portion, wherein the clutch comprises an engaging clutch which is moved to one of a gas supply drive member which transmits the power to the gas supply source and a stitch forming drive member which is fastened to one end of the drive shaft and transmits the power to the stitch forming device so that approach/separation becomes free depending on a manual operation of a looper threading/stitch forming changeover manual operating portion and which transmits the power from the sewing machine motor through a clutch hollow shaft and retains the connecting state when connecting to the gas supply drive member.

In the gas carrying threading device of sewing machine of the present invention, at the time of the looper threading, the clutch hollow shaft is combined to a changeover slide sleeve which is changed over and slides depending on the manual operation of the looper threading/stitch forming changeover manual operating portion through a slidable rotation transmission key and connected to the gas supply drive member by an engaging and biting claw, and at the time of the stitch formation, the clutch hollow shaft is connected to the stitch forming drive member by an engaging claw through the changeover slide sleeve.

In the gas carrying threading device of sewing machine of the present invention, the looper thread guide outlet and the looper thread inlet comprise a threading connecting device which is disposed so that approach/separation becomes free at the time of the looper threading and at the time of the stitch formation respectively depending on the manual operation of the looper threading/stitch forming changeover manual operating portion.

In the gas carrying threading device of sewing machine of the present invention, by rotating a pulley which is fastened at one end of the drive shaft manually, when the looper thread guide outlet and the looper thread inlet are aligned horizontally, a positioning device which connects the looper thread guide outlet of the hollow looper thread guide and the looper thread inlet of the looper is provided.

In the gas carrying threading device of sewing machine of the present invention, the positioning device has a stop positioning plate, which is coaxially attached at the drive shaft and has a notch at the stop position of the circumferential direction for aligning horizontally the positions of the looper thread guide outlet, a thread take-up lever hole which is formed at a looper take-up lever and the looper thread inlet, and has a stopper shaft, which is fitted to the notch by rotating the pulley manually at the time of the looper threading that the looper threading/stitch forming changeover manual operating portion is changed over manually to the looper threading side.

In the gas carrying threading device of sewing machine of the present invention, a control pin which is protruded at the stopper shaft and a control groove cam plate including a first control groove cam portion which moves the stopper shaft so as to separate from the stop positioning circular plate by the control pin at the time of stitch formation and a second control groove cam portion which moves the stopper shaft toward the stop positioning circular plate by the control pin at the time of looper threading are provided.

In the gas carrying threading device of sewing machine of the present invention, the changeover slide sleeve is connected to the gas supply drive member at the time of the looper threading by changing over and sliding depending on the manual operation of the looper threading/stitch forming changeover manual operating portion through a two steady states changeover plate, and is connected to the stitch forming drive member at the time of stitch formation.

Effect of the Invention

According to the gas carrying threading device of sewing machine of the present invention, the transition to the stitch forming state from the looper threading state can be avoided during the gas supply operation of the gas supply pump by any manual operation of a looper threading/stitch forming changeover manual operating portion.

Besides, according to the gas carrying threading device of sewing machine of the present invention, the looper threading can be performed by one-handed three operations which are a threading preparatory operation, a threading positioning/connecting pulley operation and a threading gas supply operation.

Therefore, according to the gas carrying threading device of sewing machine of the present invention, the transition to the stitch forming state from the looper threading state can be avoided during the gas supply operation of the gas supply pump by any manual operation of a looper threading/stitch forming changeover manual operating portion, and by connecting with the hollow thread guide which leads to the looper thread introduction mechanism which inserts the thread from the thread outlet of the loop-taker point of the looper, the complicated thread guard is unnecessary and the threading that the handleability is easy can be performed. And, there are no mistake of the threading, no protrusion of the looper thread in mid-process, and no entanglement of the inserted looper thread with other thread. Besides, because the looper thread is fed by utilizing the flow of the pressurized gas which is supplied to the hollow looper thread guide, the threading can be performed at once by the extremely easy operation.

BRIEF DESCRIPTION OF THE DRAWINGS

[FIG. 3 (B)] A partial perspective view in a threading state of a gas carrying threading device of sewing machine by the present invention.

[FIG. 3 (C)] An exploded perspective view of a threading connecting device in a gas carrying threading device of sewing machine by the present invention.

[FIG. 5 (B)] (a) is a partial perspective view of a looper threading/stitch forming changeover mechanism in a threading state of a gas carrying threading device of sewing machine by the present invention, and (b) is a detailed explanatory view of that control groove cam plate.

[FIG. 5 (C)] (a) is an exploded perspective view of a looper threading/stitch forming changeover mechanism of a gas carrying threading device of sewing machine by the present invention, and (b) is a partial detailed exploded perspective view thereof.

[FIG. 6 (B)] Partial perspective view of a looper threading/stitch forming changeover manual operating portion and a looper threading/stitch forming changeover mechanism in a threading state of a gas carrying threading device of sewing machine by the present invention.

[FIG. 7 (B)] A partial perspective view of an engaging clutch in a gas carrying threading device of sewing machine by the present invention.

[FIG. 8 (B)] A sectional view of an engaging clutch in a threading state of a gas carrying threading device of sewing machine by the present invention.

MODE FOR CARRYING OUT THE INVENTION

Figure 1:
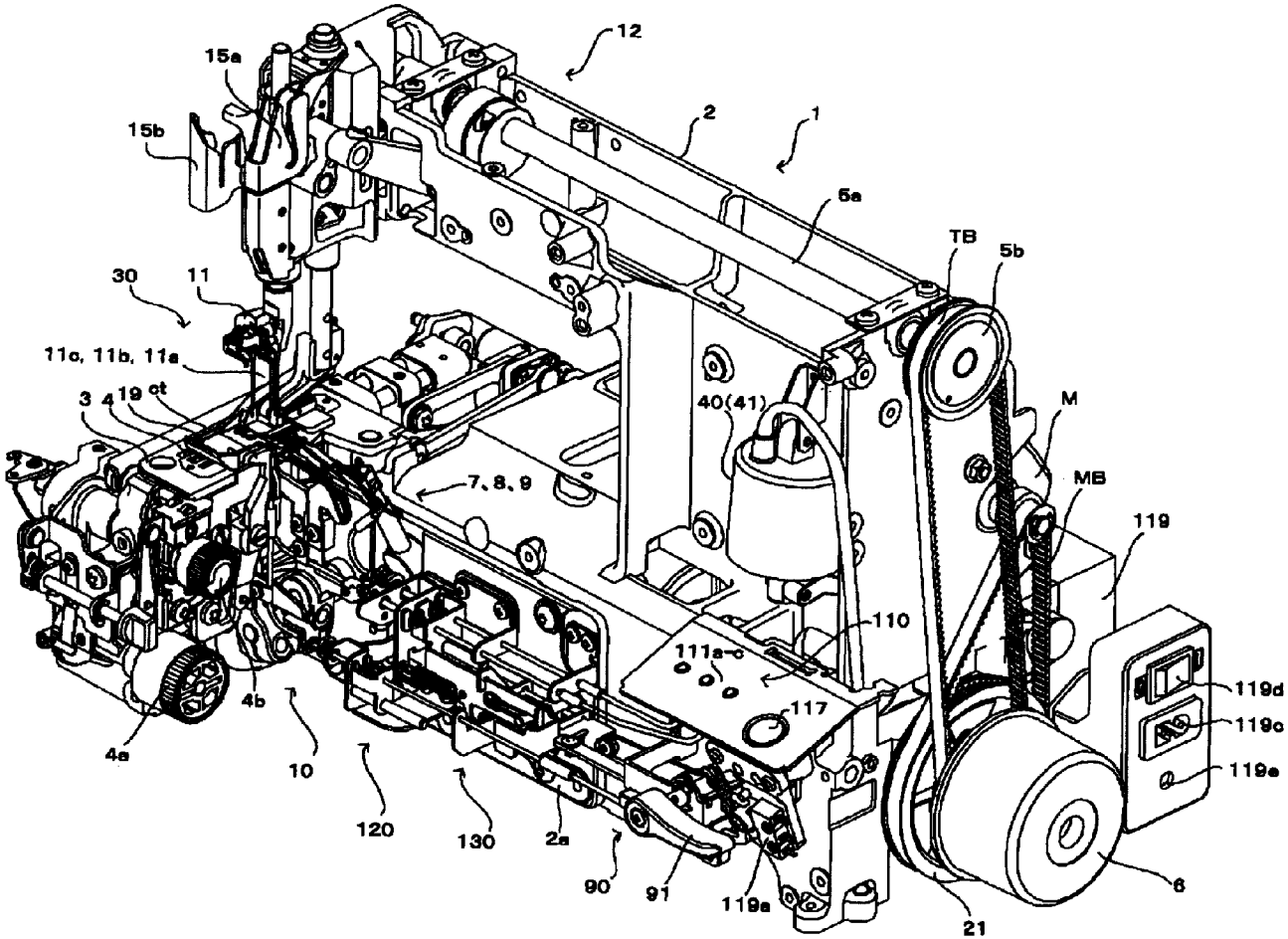
[FIG. 1] A whole perspective view seeing a gas carrying threading device of sewing machine by the present invention from a right side

Hereinafter, the preferable embodiment that the gas carrying threading device of sewing machine of the present invention is applied to a 3 (three) needles 6 (six) threads hemstitch overlook machine is explained in detail by referring to the drawings.

As shown in FIG. 1, this 3 needles 6 threads hemstitch overlook machine 1 has a main frame 2 and a sub frame 2*a* which form a bed and an arm.

Figure 2:
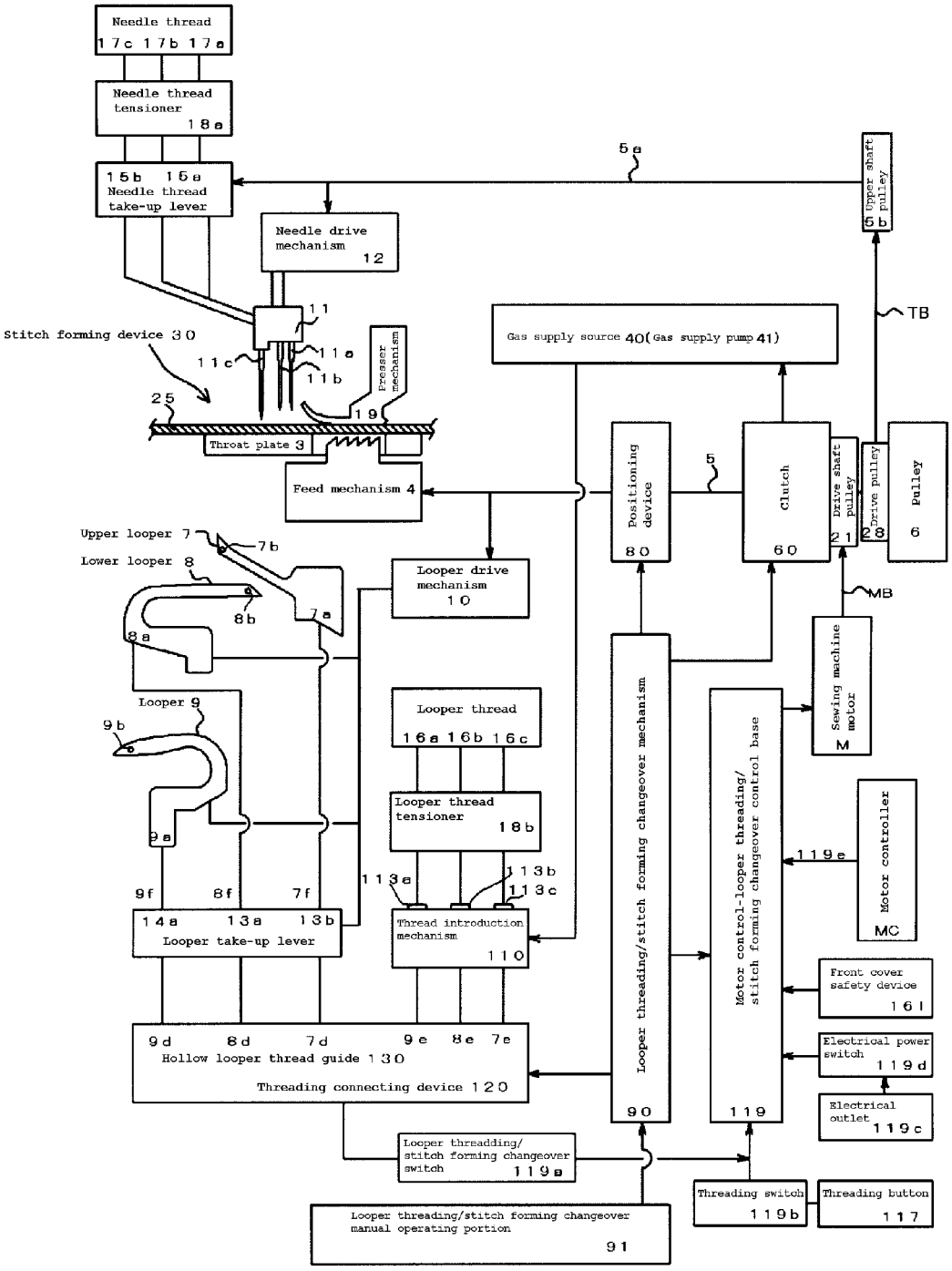
[FIG. 2] A block diagram of a gas carrying threading device of sewing machine by the present invention.
Figure 3A:
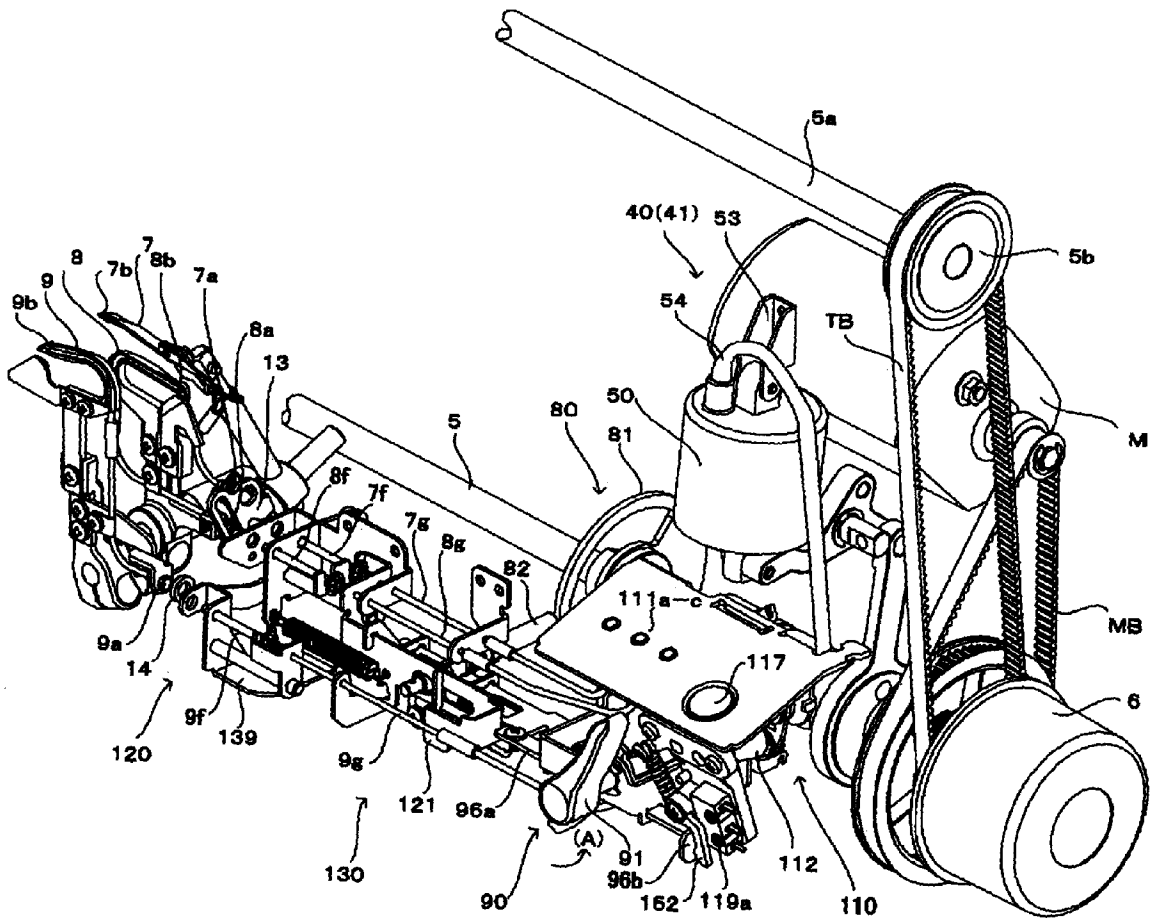
[FIG. 3 (A)] A partial perspective view in a stitch forming state of a gas carrying threading device of sewing machine by the present invention.
Figure 3B:
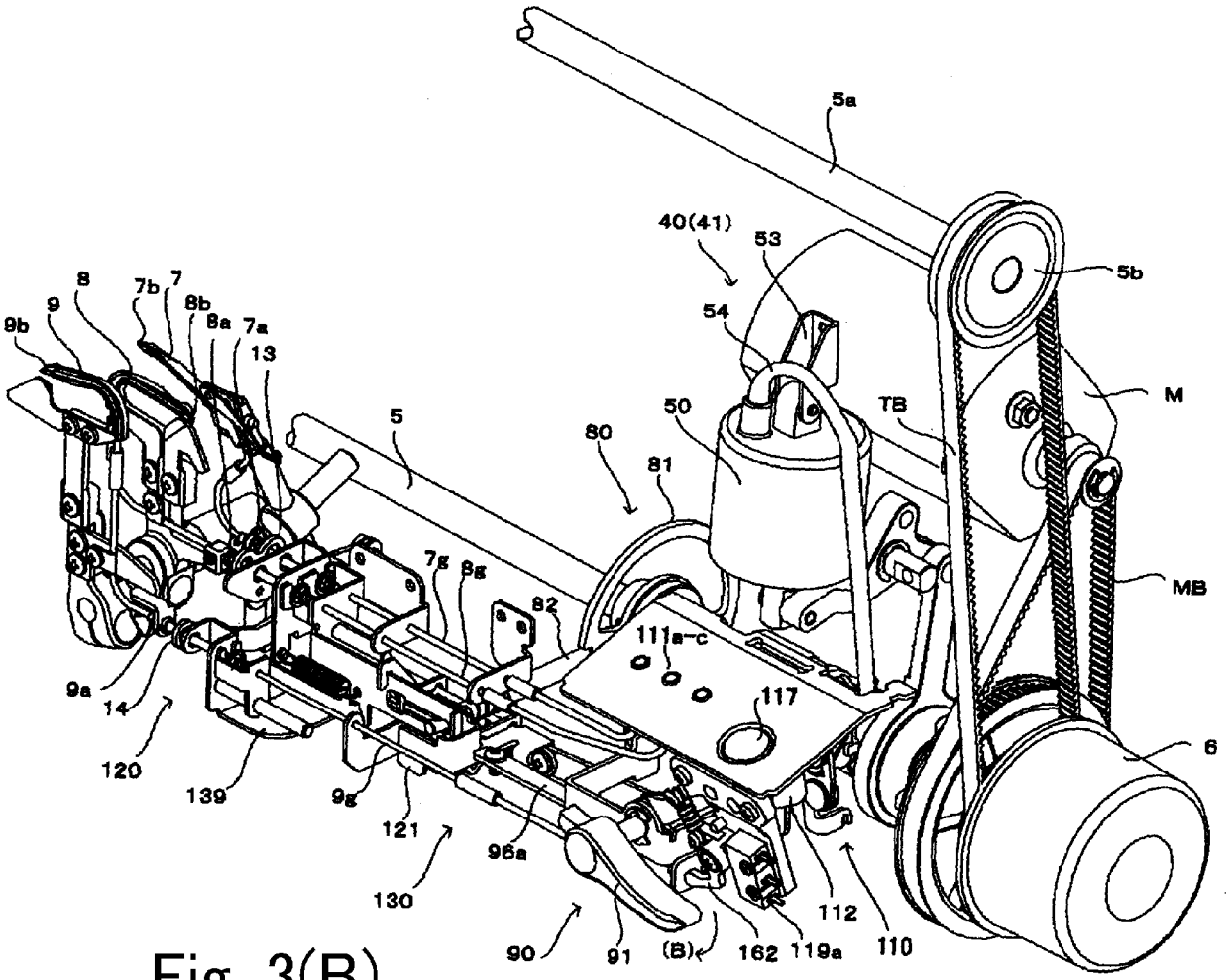
Figure 3C:
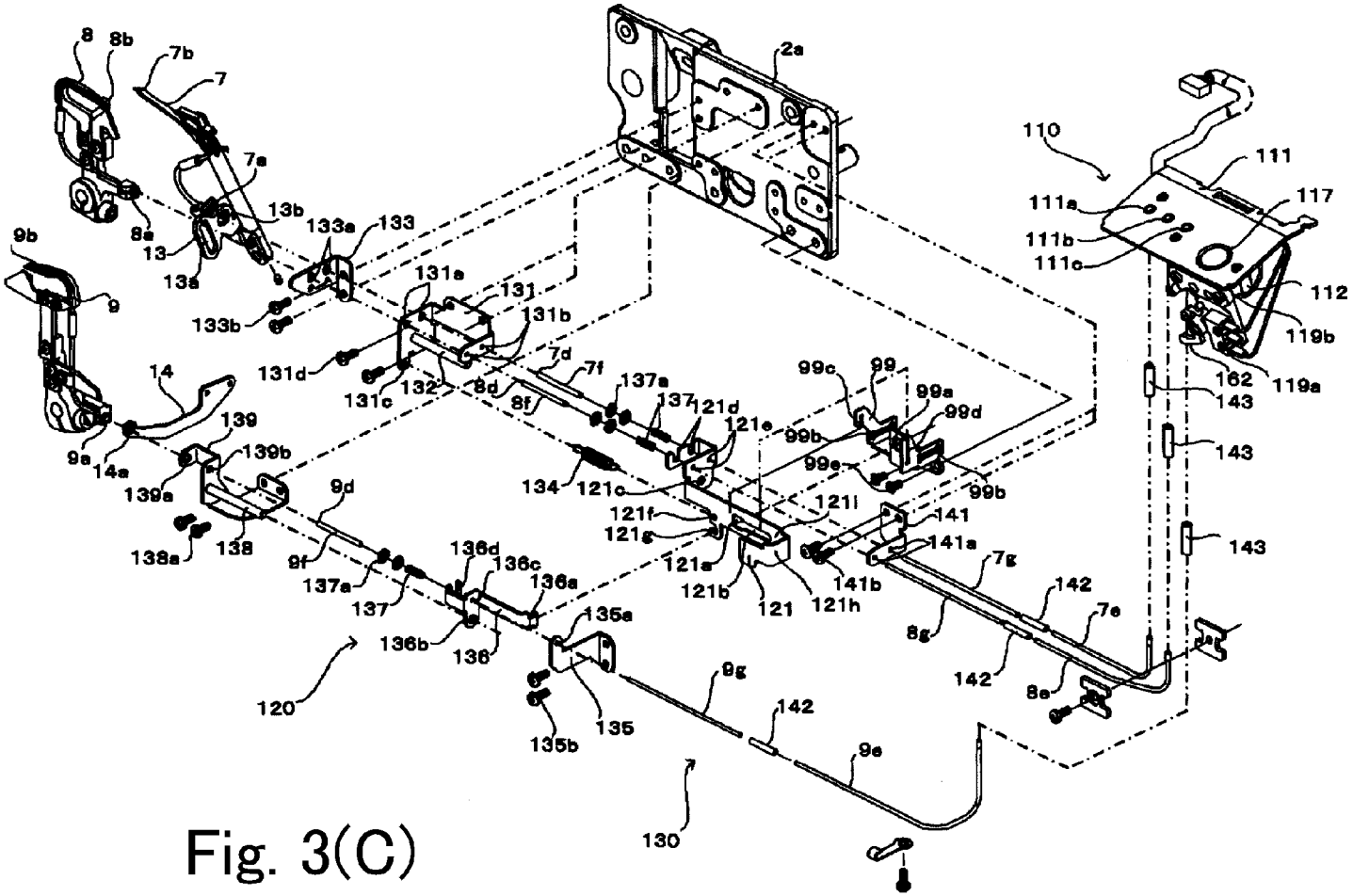
Figure 6A:
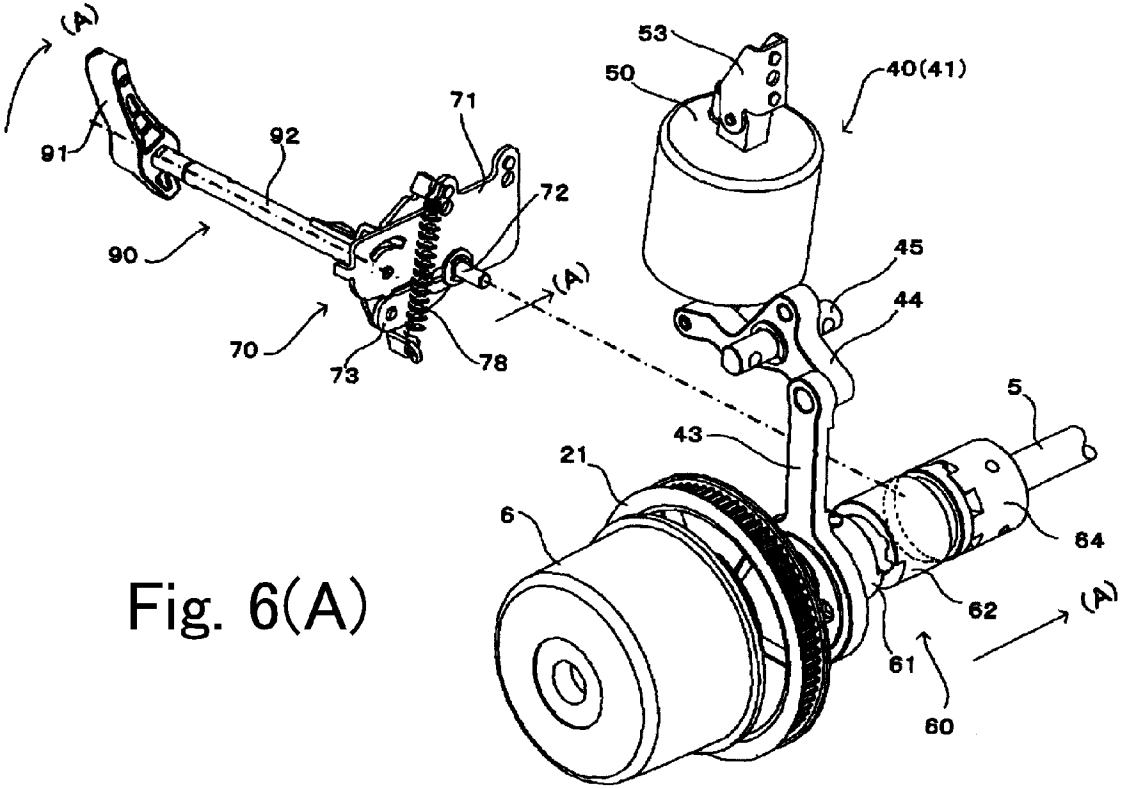
[FIG. 6 (A)] Partial perspective view of a looper threading/stitch forming changeover manual operating portion and a looper threading/stitch forming changeover mechanism in a stitch forming state of a gas carrying threading device of sewing machine by the present invention.
Figure 6B:
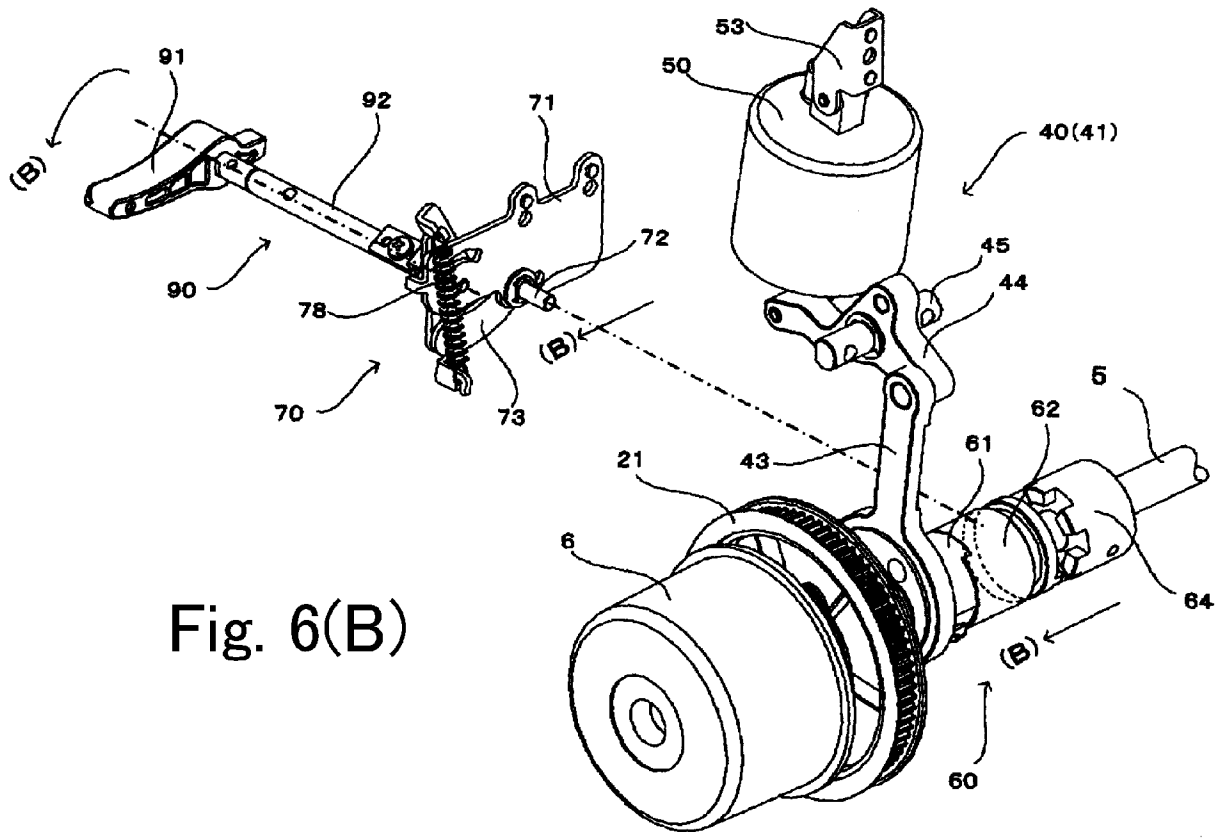
Figure 7A:
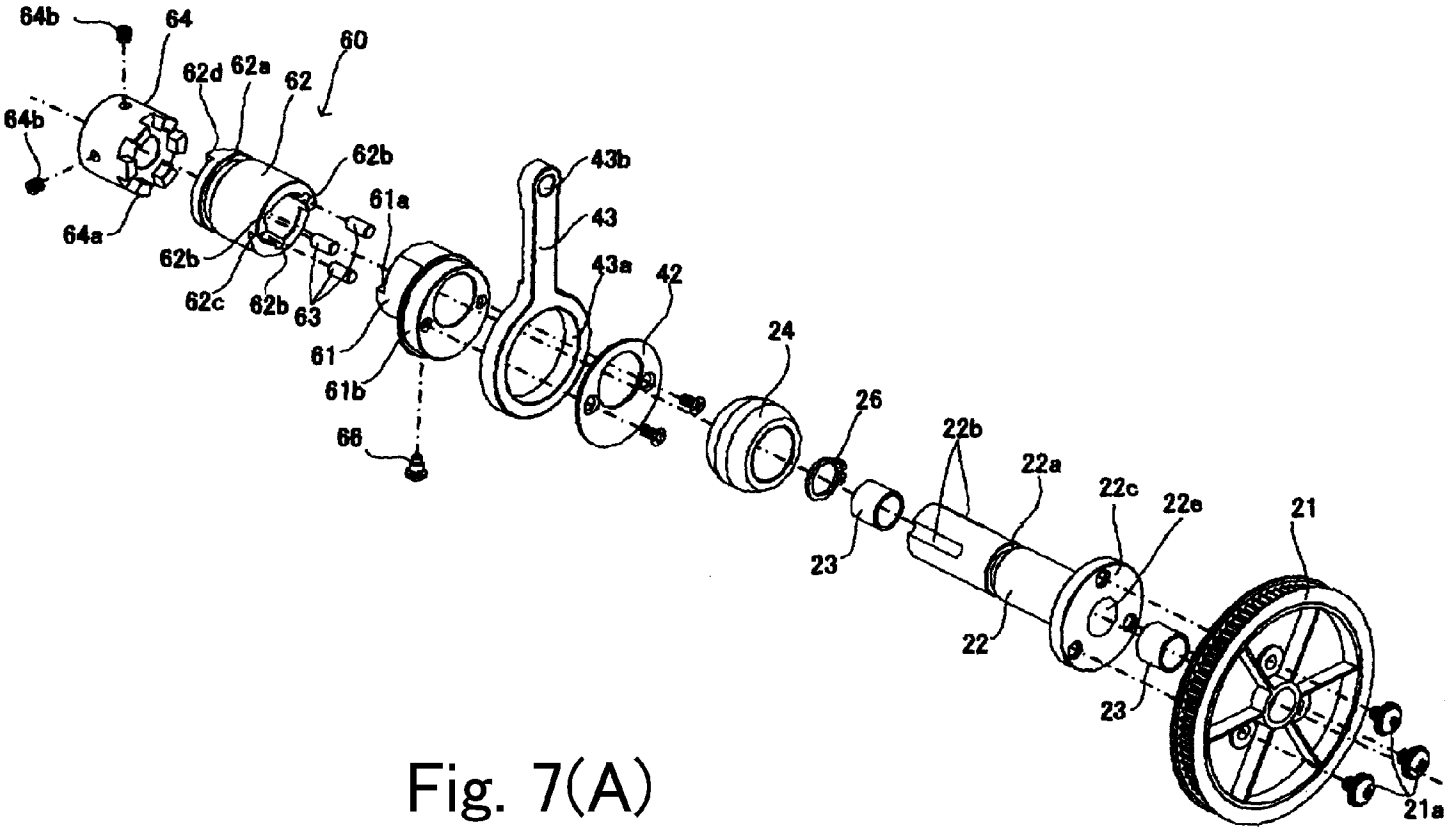
[FIG. 7 (A)] An exploded perspective view of an engaging clutch in a gas carrying threading device of sewing machine by the present invention.
Figure 7B:
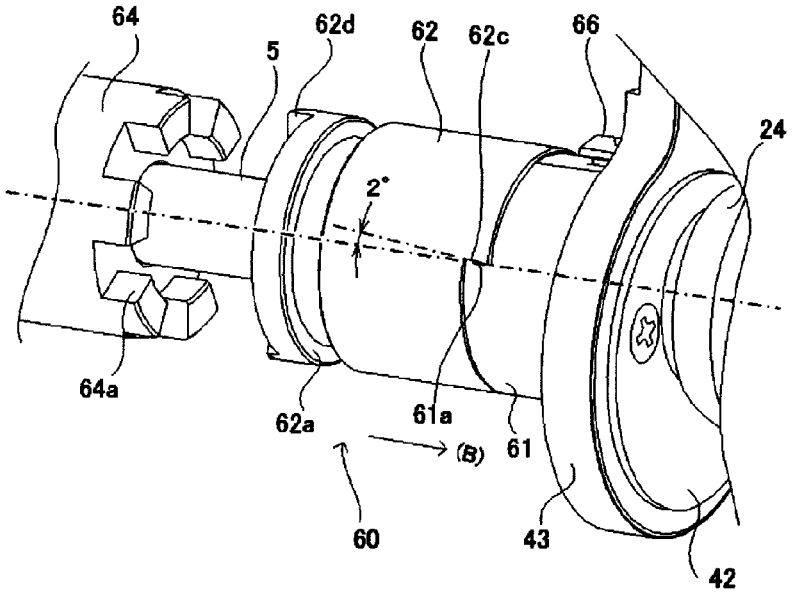
Figure 8A:
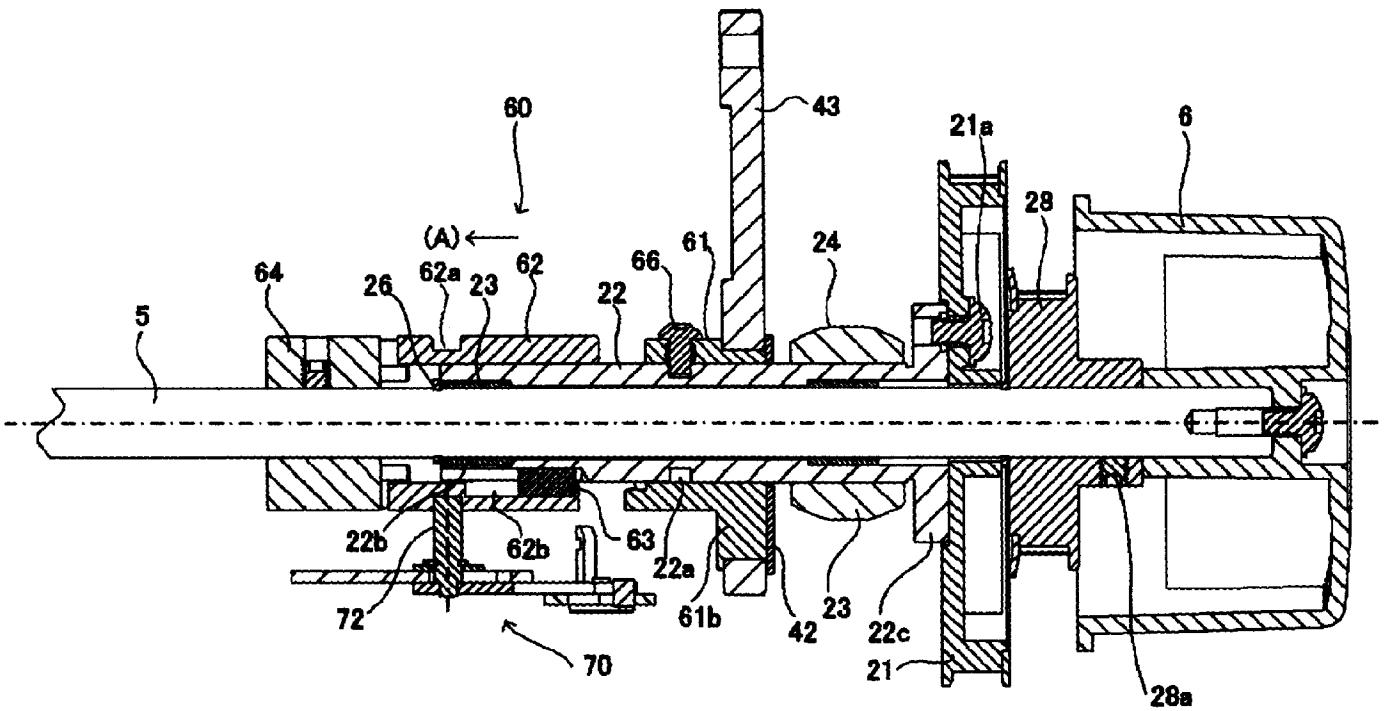
[FIG. 8 (A)] A sectional view of an engaging clutch in a stitch forming state of a gas carrying threading device of sewing machine by the present invention.
Figure 8B:
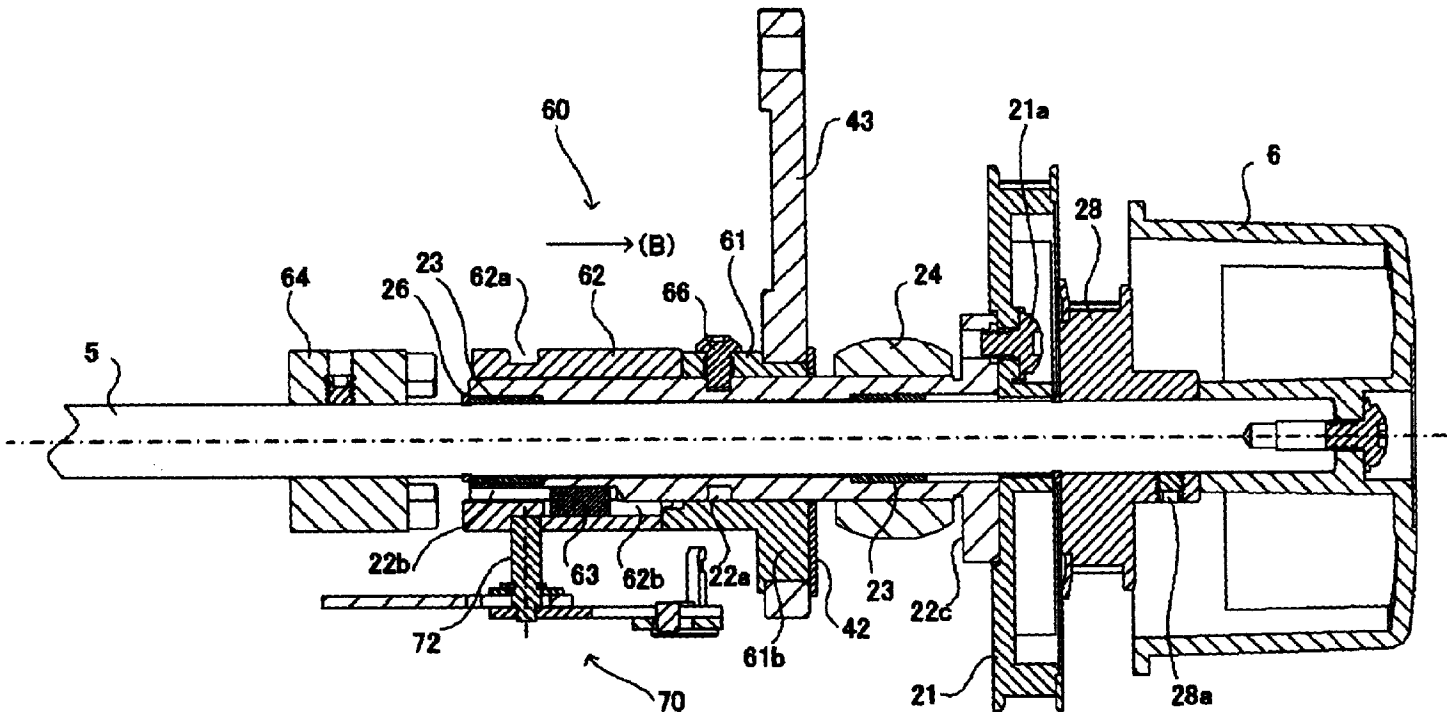
Figure 9:
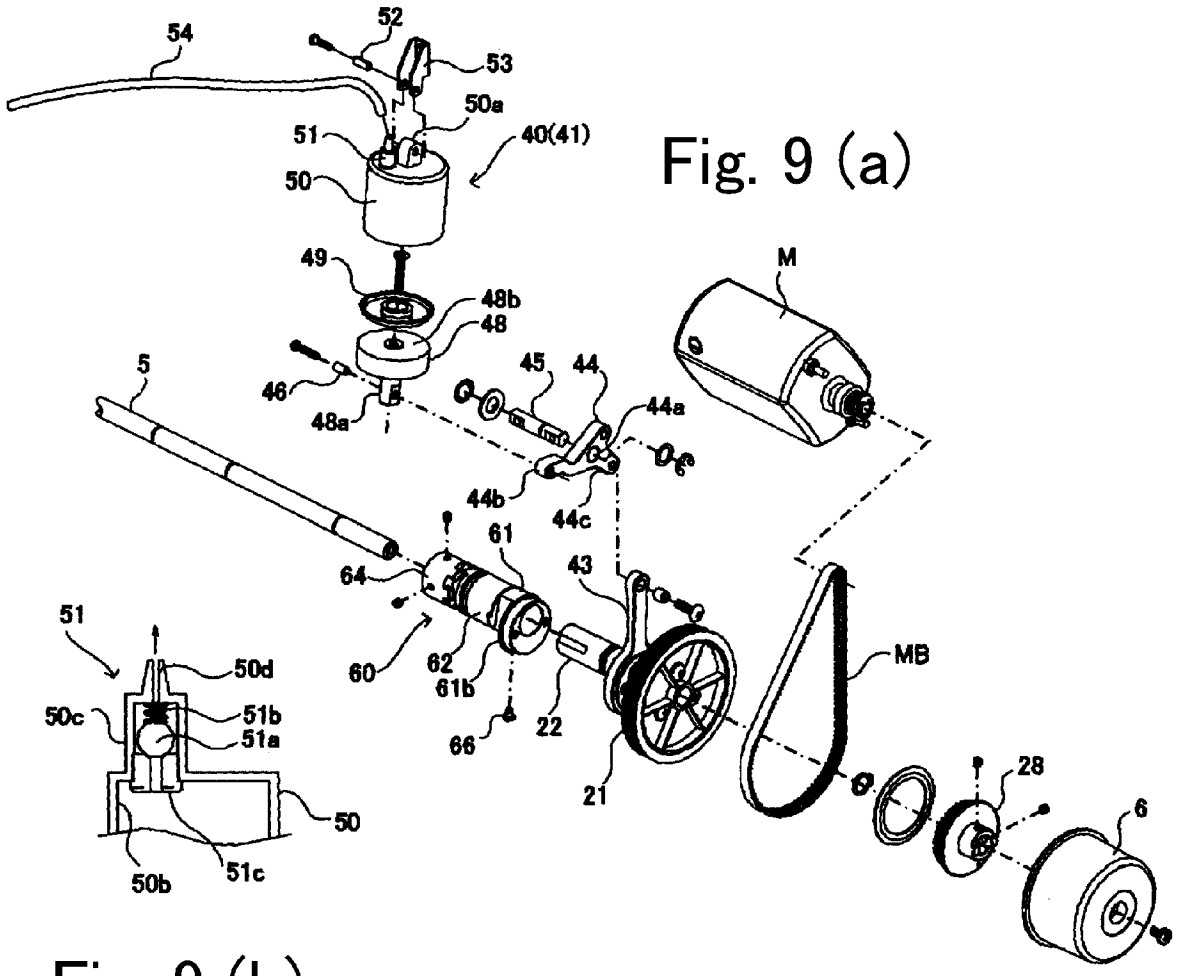
[FIG. 9] (*a*) is an exploded perspective views of an engaging clutch and gas supply pump of a gas carrying threading device of sewing machine by the present invention, and (b) is a detailed explanatory view of that back flow stopper valve.

A sewing machine motor M is attached to the main frame 2, and a drive shaft 5 extends horizontally along the main frame 2 (FIG. 2, FIG. 3 (A), FIG. 3 (B), FIG. 5 (A), FIG. 5 (B), FIG. 6 (A), FIG. 6 (B), FIG. 7(B), FIG. 8 (A), FIG. 8 (B), FIG. 9 (*a*)).

As described below, the drive shaft 5 is rotated and driven by using a timing belt MB and a drive pulley 21 by the sewing machine motor M through an after-mentioned clutch 60.

As shown in FIG. 1, FIG. 2, FIG. 8 (A), FIG. 8 (B) and FIG. 9 (a), an upper shaft 5*a* which rotates with a drive shaft pulley 28, a timing belt TB and an upper shaft pulley 5*b* by synchronizing to a drive shaft 5 is provided. The drive shaft pulley 28 is fixed to the drive shaft 5 by a screw 28*a* in order to drive the upper shaft 5*a* by synchronizing to a drive shaft 5. A rotational speed ratio of the drive shaft 5 and the upper shaft 5*a* is 1:1. A stitch forming device 30 is formed by needles 11*a*, 11*b*, 11*c* which perform vertical motion by being fixed at a needle clamp 11 which performs vertical motion by the upper shaft 5*a* and piercing a throat plate 3, a needle drive mechanism 12 which drives these needles 11*a*, 11*b*, 11*c*, a presser foot mechanism 19 which presses a cloth 25 on the throat plate 3, a lower looper 8 which is driven by the drive shaft 5 and traces the arc-like trajectory which intersects with the trajectory of the needles 11*a*, 11*b*, 11*c* at the under side of the throat plate 3 and reciprocates, a upper looper 7 which traces the oval trajectory which intersects with the trajectory of the lower looper 8 at the side of the throat plate 3 and intersects with the trajectory of the needles 11*a*, 11*b*, 11*c* at the upper side of the throat plate 3 and reciprocates, a double chain stitch looper 9 (FIG. 3 (A)-FIG. 3 (C)), a looper drive mechanism 10 which drives these loopers and a cloth feed mechanism 4 which forwards the cloth 25 every one stitch.

Besides, in the 3 needles 6 threads hemstitch overlock machine 1, a cutter ct for cutting an edge of the cloth 25 is provided. Further, a cloth feed pitch controller 4*a* for controlling a cloth feed pitch by the cloth feed mechanism 4 and a cutting width controller 4*b* for controlling a cutting width by the cutter ct are provided.

The needle drive mechanism 12 of the stitch forming device 30 is driven by the upper shaft 5*a* which is driven by synchronizing to the drive shaft 5, and the cloth feed mechanism 4, the looper drive mechanism 10 and the cutter ct are driven by the drive shaft 5. In a word, although the stitch forming device 30 is basically driven by the drive shaft 5, because the concrete structure and the motion are public known or well-known, the detailed explanation is omitted.

According to the 3 needles 6 threads hemstitch overlook machine 1, an overlook stitch is formed on the cloth 25 by crossing the needle threads 17*a*, 17*b* which are inserted to the needles 11*a*, 11*b*, a lower looper thread 16*b* which is inserted to the lower looper 8 and an upper looper thread 16*a* which is inserted to the upper looper 7. In addition, the double chain stitch looper 9 forms a double chain stitch on the cloth 25 by crossing a double chain stitch looper thread 16*c* which is inserted to the looper 9 and a needle thread 17*c* which is inserted to the needle 11*c*, and a so-called interlock stitch is performed. The needle threads 17*a*, 17*b*, 17*c* are supplied to the needles 11*a*, 11*b*, 11*c* respectively through a needle thread tensioner 18*a* and needle thread take-up levers 15*a*, 15*b*.

In this 3 needles 6 threads hemstitch overlook machine 1, when inserting each looper thread 16*a*, 16*b*, 16*c* to the upper looper 7, the lower looper 8 and the double chain stitch looper 9 through a looper thread tensioner 18*b* by the gas carrying, the upper looper 7, the lower looper 8 and the double chain stitch looper 9 are the hollow structures from looper thread inlets 7*a*, 8*a*, 9*a* to looper loop-taker point thread outlets 7*b*, 8*b*, 9*b* (FIG. 3 (A)-FIG. 3 (C)). Here, "hollow structure" may compose the looper itself as the hollow structure from the looper thread inlets 7*a*, 8*a*, 9*a* to the looper loop-taker point thread outlets 7*b*, 8*b*, 9*b* and may compose the structure that a groove is formed in the looper from the looper thread inlets 7*a*, 8*a*, 9*a* to the looper loop-taker point thread outlets 7*b*, 8*b*, 9*b* and that a hollow pipe is embedded in there. In this case, a cross-section of the structure may be a circle or a polygon, and for example, the cross-section may be C-shape that a part lacks.

For this purpose, the 3 needles 6 threads hemstitch overlock machine 1 is equipped with a looper thread introduction mechanism 110 which inserts each looper thread which is led to the upper looper 7, the lower looper 8 and the double chain stitch looper 9 and a gas supply source 40 that the looper threading of each looper thread is performed by the gas carrying to the looper thread guide outlets 7*d*, 8*d*, 9*d* by a threading connecting device 120 through the hollow looper thread guides 7*e*, 8*e*, 9*e*, 7*g*, 8*g*, 9*g*, 7*f*, 8*f*, 9*f* of a hollow looper thread guide 130 which extends from the looper thread introduction mechanism 110 to the looper thread inlets 7*a*, 8*a*, 9*a* and has the looper thread guide outlets 7*d*, 8*d*, 9*d* (FIG. 1, FIG. 2, FIG. 3 (A)-FIG. 3 (C), FIG. 5 (A), FIG. 5 (B), FIG. 6 (A), FIG. 6 (B)).

The looper thread introduction mechanism 110 has wide-mouthed looper thread insertion slots 113*a*, 113*b*, 113*c* which insert each looper, and is connected to the hollow looper thread guides 7*e*, 8*e*, 9*e*.

Figure 10:
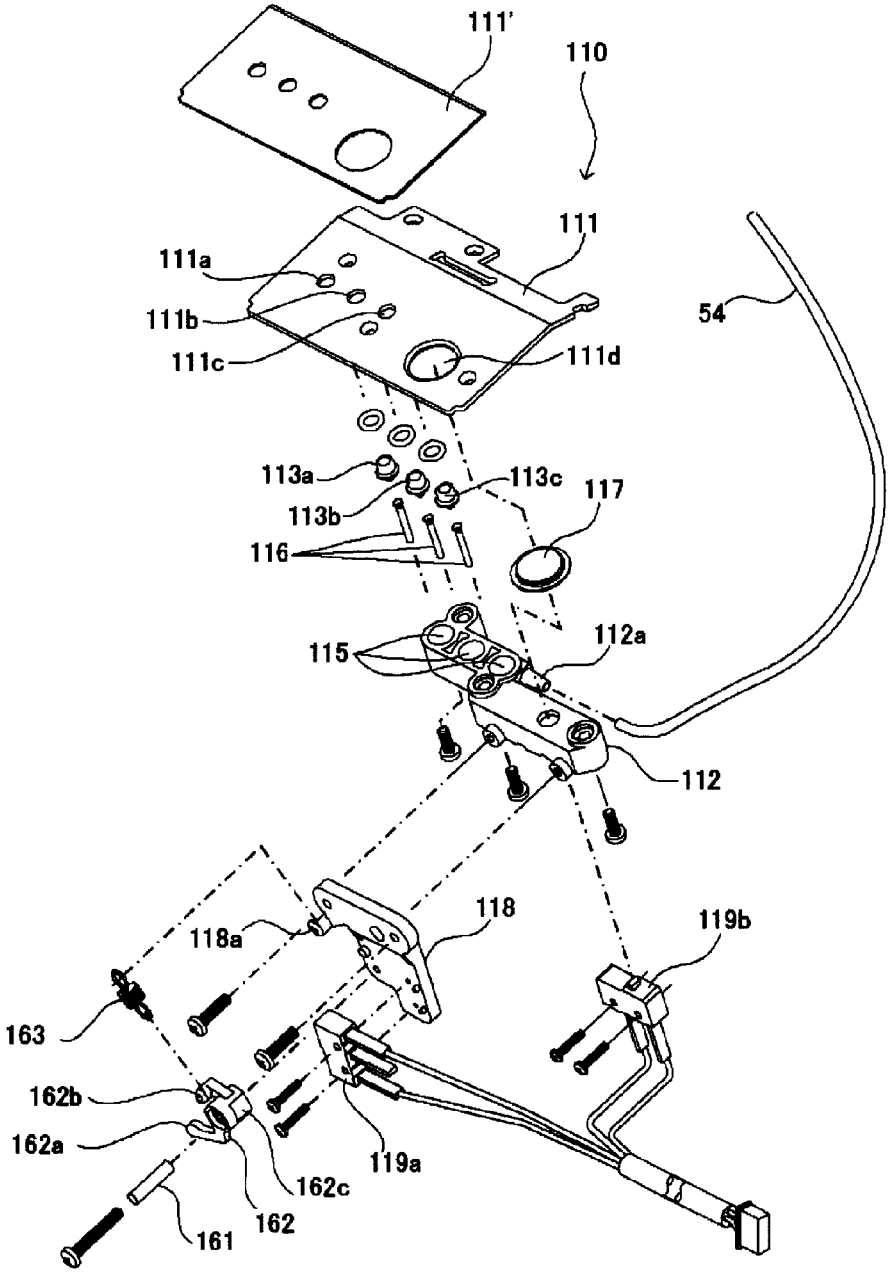
[FIG. 10] An exploded perspective view of a looper thread introduction mechanism of a gas carrying threading device of sewing machine by the present invention.

As shown in FIG. 3 (A)-FIG. 3 (C) and FIG. 10, the looper thread introduction mechanism 110 is formed on a looper thread introduction pedestal 112. Besides, a threading button 117 is formed at the looper thread introduction pedestal 112. Looper thread insertion slot holes 111*a*, 111*b*, 111*c* and a threading button hole 111*d* where the wide-mouthed looper thread insertion slots 113*a*, 113*b*, 113*c* and the threading button 117 face are provided at a thread insert plate 111.

A threading switch 119*b* which operates by pressing the threading button 117 is provided on the looper thread introduction pedestal 112 together with a looper threading/stitch forming changeover switch 119*a* which operates by the operation of a looper threading/stitch forming changeover manual operating portion (looper threading/stitch forming changeover manual lever) 91 of a looper threading/stitch forming changeover mechanism 90 as described below (FIG. 3 (A)-FIG. 3 (C), FIG. 10).

In the looper threading/stitch forming changeover switch 119*a*, at the time of threading preparatory state or looper threading as described below, a changeover switch arm 162 which is attached pivotally swingably at an axis 161 which is fixed on the looper thread introduction pedestal 112 is provided so that a changeover switch arm cam 162*c* does not press the looper threading/stitch forming changeover switch 119*a* by elastic repulsion of a tension spring 163 which is stretched between a spring stud 118*a* of the looper thread introduction pedestal 112 and a changeover switch arm spring stud 162*b*. The operation is described below.

As shown in FIG. 1, FIG. 2, FIG. 3 (A)-FIG. 3 (C), in the 3 needles 6 threads hemstitch overlock machine 1, as described below, the looper threading and the sewing by sewing machine are performed by utilizing the threading connecting device 120 which comprises the upper looper 7, the lower looper B and the double chain stitch looper 9 which are the hollow structures from the looper thread inlets 7*a*, 8*a*, 9*a* to the looper loop-taker point thread outlets 7*b*, 8*b*, 9*b*, the looper thread introduction mechanism 110 which inserts the looper threads which are led to the upper looper 7, the lower looper and the double chain stitch looper 9, and the hollow looper thread guides 7*e*, 8*e*, 9*e*, 7*g*, 8*g*, 9*g*, 7*f*, 8*f*, 9*f* of the hollow looper thread guide 130 which extend from the looper thread introduction mechanism 110 to the looper thread inlets 7*a*, 8*a*, 9*a* and has the looper thread guide outlets 7*d*, 8*d*, 9*d*.

The 3 needles 6 threads hemstitch overlook machine 1 has the gas supply pump 41 which is the gas supply source 40 that the looper threading is performed in each looper thread by the gas carrying from the looper thread introduction mechanism 110 to the looper thread guide outlets 7*d*, 8*d*, 9*d* through the hollow looper thread guides 7*e*, 8*e*, 9*e*, 7*g*, 8*g*, 9*g*, 7*f*, 8*f*, 9*f* of the hollow looper thread guide 130, the clutch 60 for respectively transmitting the power from the sewing machine motor M to the drive shaft 5 which drives the stitch forming device 30 including the upper looper 7, the lower looper 8 and the double chain stitch looper 9 at the time of the stitch formation or to the gas supply pump 41 at the time of the looper threading, and the looper threading/stitch forming changeover mechanism 90 for changing over the clutch 60 so that the transmission of the power to the stitch forming device 30 is interrupted and the power is transmitted to the gas supply pump 41 at the time of the looper threading and the power is transmitted to the stitch forming device 30 and the transmission of the power to the gas supply pump 41 is interrupted at the time of the stitch formation.

As shown in FIG. 6 (A), FIG. 6 (B), FIG. 7 (A), FIG. 9 (*a*) and (*b*), at the time of the looper threading, the gas supply pump 41 comprises a piston 48 which reciprocates by a pump drive arm 44 which is pivotally supported by a spindle 45 because a pump drive rod 43 reciprocates by a pump drive (eccentric) cam 61*b* which is rotated by a gas supply drive member 61 of the clutch 60, a piston cap 49, a pump cylinder 50 that this slides in an airtight state, and that back flow stopper valve 51.

A cylinder attaching portion 50*a* is attached at the main frame 2 by a pump attaching pedestal 53 so that the swing is allowed by a cylinder attaching pin 52.

The piston 48 is attached at a piston shaft 48*a*, and the piston cap 49 which is formed with the folding-fan shape toward the discharge direction and is a seal material is fixed at a piston head portion 48*b*.

The back flow stopper valve 51 has a spring 51*b*, a back flow stopper ball 51*a* which is pressed by the spring 51*b*, and a valve seat 51*c* which is screwed at a valve housing 50*c* and closes the valve by seating the back flow stopper ball 51*a* by pressing the spring 51*b* at the time of a return (inhalation) process and opens the valve by floating the back flow stopper ball 51*a* by the delivery pressurized air at the time of the pressurization (forward) process in the valve housing 50*c* which is connected to the pump cylinder 50 and a delivery port 50*b*.

In the operation of the gas supply pump 41, concerning a forward process of the piston 48, the piston cap 49 is connected to the inner wall surface of the pump cylinder 50 in the airtight state, and the air is compressed, and pressurized and injected as the compressed air from the delivery port 50*b* to an air inlet 112*a* (FIG. 10) of the looper thread introduction mechanism 110 through a pipe 54. On the other hand, in the return (inhalation) process of the piston 48, because the piston cap 49 is not connected to the inner wall surface of the pump cylinder 50 in the airtight state, the air is inhaled through the outer circumference of the piston 48 and the piston cap 49, and the back flow of the air which is sent from the delivery port 50*b* is prevented by the back flow stopper ball 51*a* of the back flow stopper valve 51.

As shown in FIG. 1, FIG. 2, FIG. 7 (A), FIG. 7 (B), FIG. 8 (A), FIG. 8 (B) and FIG. 9 (*a*), the clutch 60 comprises an engaging clutch which is moved to one of the gas supply drive member 61 which transmits the power to the gas supply pump 41 and a stitch forming drive member 64 which is fastened to one end of the drive shaft 5 and transmits the power to the stitch forming device 30 so that approach/separation becomes free depending on a manual operation of a looper threading/stitch forming changeover manual operating portion (looper threading/stitch forming changeover manual lever) 91 and transmits the power from the sewing machine motor M through a clutch hollow shaft 22 and retains the connecting state when connecting to the gas supply drive member 61. Hereinafter, the clutch is called as the engaging clutch 60.

As discussed in detail, in the engaging clutch 60, on a shaft line of the drive shaft 5, a clutch hollow shaft flange 22*c* is formed at one end of the clutch hollow shaft 22, and a drive shaft pulley 21 that the power from the sewing machine motor M is transmitted by the timing belt MB is fixed at the clutch hollow shaft flange 22*c* by a screw 21*a*. The drive shaft 5 is fitted into the clutch hollow shaft 22 rotatably by two metals 23. The clutch hollow shaft 22 is positioned at the drive shaft 5 by a C-shaped snap ring 26 so that the clutch hollow shaft 22 cannot move axially. Further, the outer circumference of the clutch hollow shaft 22 is fitted into a spherical metal 24 rotatably and attached to the main frame 2.

A gas supply drive member positioning groove 22*a* that a tip of a positioning shoulder screw pin 66 is fitted slidably is provided at the outer circumference of the clutch hollow shaft 22, and the gas supply drive member 61 is fitted rotatably by the positioning shoulder screw pin 66 so that the gas supply drive member 61 cannot move axially.

Besides, the stitch forming drive member 64 is fixed at the drive shaft 5 by a screw 64*b*.

Further, also, a changeover slide sleeve 62 is fitted into the outer circumference of the clutch hollow shaft 22 rotatably. Semicircular grooves 62*b*, 22*b* for fitting slidable rotation transmission keys 63 are provided respectively in the changeover slide sleeve 62 and the clutch hollow shaft 22. A control groove 62 that a clutch changeover pin 72 (FIG. 6 (A), FIG. 6 (B)) of the looper threading/stitch forming changeover mechanism 90 for changing over the engaging clutch 60 is fitted loosely is provided around the outer circumference of the changeover slide sleeve 62.

Engaging and biting claws 61*a*, 62*c* are formed respectively at each end face of the gas supply drive member 61 and the changeover slide sleeve 62 so that they engage and bite mutually when connecting.

For example, a biting angle of the engaging and biting claws 61*a*, 62*c* is 2° (2 degree) for a plane surface passing through an axial line of the rotation (FIG. 7). This biting angle may be designed with 1°-3° (1-3 degree).

Engaging claws 62*d*, 64*a* are formed respectively at each end face of the changeover slide sleeve 62 and the stitch forming drive member 64 so that they engage mutually when connecting.

In the engaging clutch 60, at the time of the looper threading, the clutch hollow shaft 22 is combined to the changeover slide sleeve 62 which changes over and slides depending on the manual operation of the looper threading/stitch forming changeover manual operating portion 91 through the slidable rotation transmission key 63 and connected to the gas supply drive member 61 by the engaging and biting claws 61*a*, 62*c*. At the time of the stitch formation, the clutch hollow shaft 22 is connected to the stitch forming drive member 64 by the engaging claws 62*d*, 64*a* through the changeover slide sleeve 62.

In the operation of the engaging clutch 60 which is composed in this way, at the time of the looper threading, the changeover slide sleeve 62 slides to the side of the gas supply drive member 61, and the gas supply drive member 61 and the changeover slide sleeve 62 are connected by the slidable rotation transmission key 63, and the gas supply pump 41 can be driven by the pump drive rod 43 with the pump drive (eccentric) cam 61*b* (FIG. 5 (B) (a), FIG. 6 (B), FIG. 8 (B)). In this case, because the gas supply drive member 61 and the changeover slide sleeve 62 are connected by the engaging and biting claws 61*a*, 62*c* which have the above biting angles, the transition from the looper threading state to the stitch formation state can be avoided during the gas supply operation of the gas supply pump 41 even by any manual operation of the looper threading/ stitch forming changeover manual operating portion.

On the other hand, at the time of the stitch formation, the changeover slide sleeve 62 slides to the opposite side of a pulley 6, and the changeover slide sleeve 62 and the stitch forming drive member 64 are connected by the slidable rotation transmission key 63, and the drive shaft 5 can be rotated (FIG. 5 (A) (a), FIG. 6 (A), FIG. 8 (A)).

Figure 4:
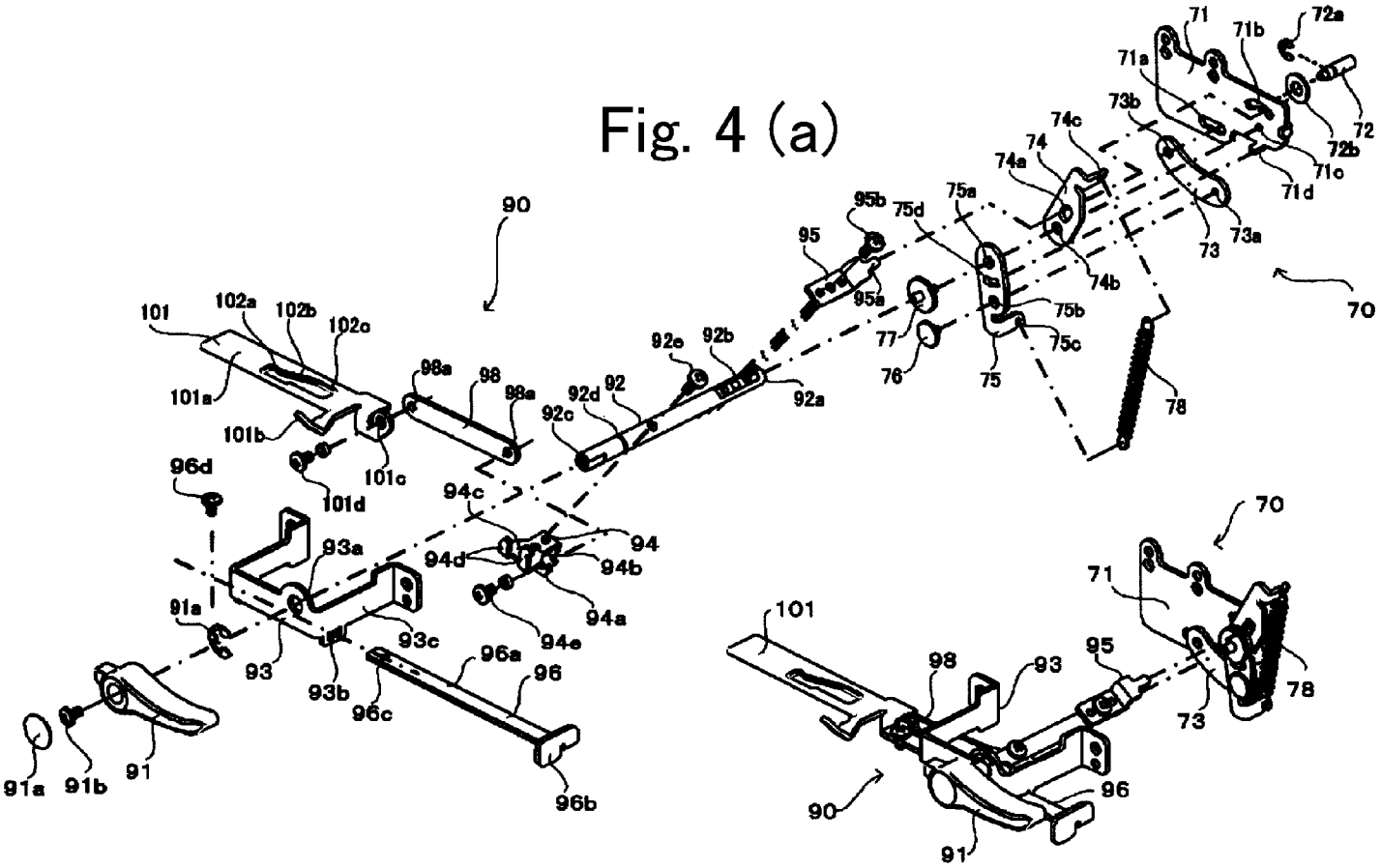
[FIG. 4] (*a*) is an exploded perspective view of a looper threading/stitch forming changeover mechanism of a gas carrying threading device of sewing machine by the present invention, and (b) is an assembling explanatory view thereof.
Figure 5A:
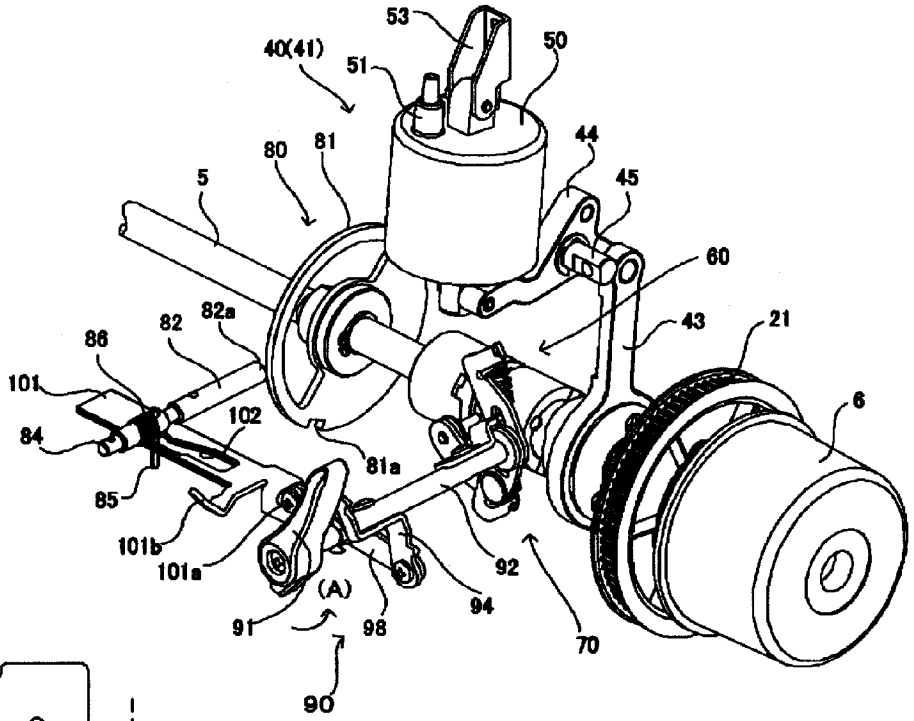
[FIG. 5 (A)] (a) is a partial perspective view of a looper threading/stitch forming changeover mechanism in a stitch forming state of a gas carrying threading device of sewing machine by the present invention, and (b) is a detailed explanatory view of that control groove cam plate.
Figure 5A:
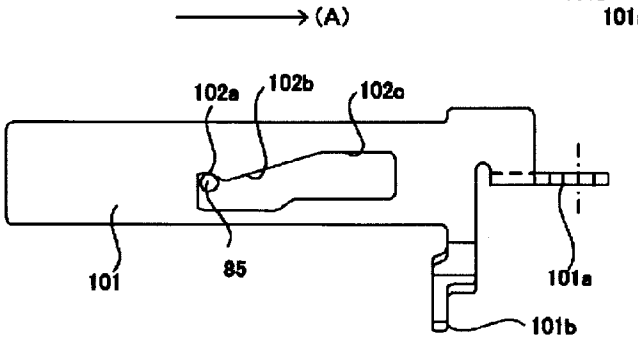
Figure 5B:
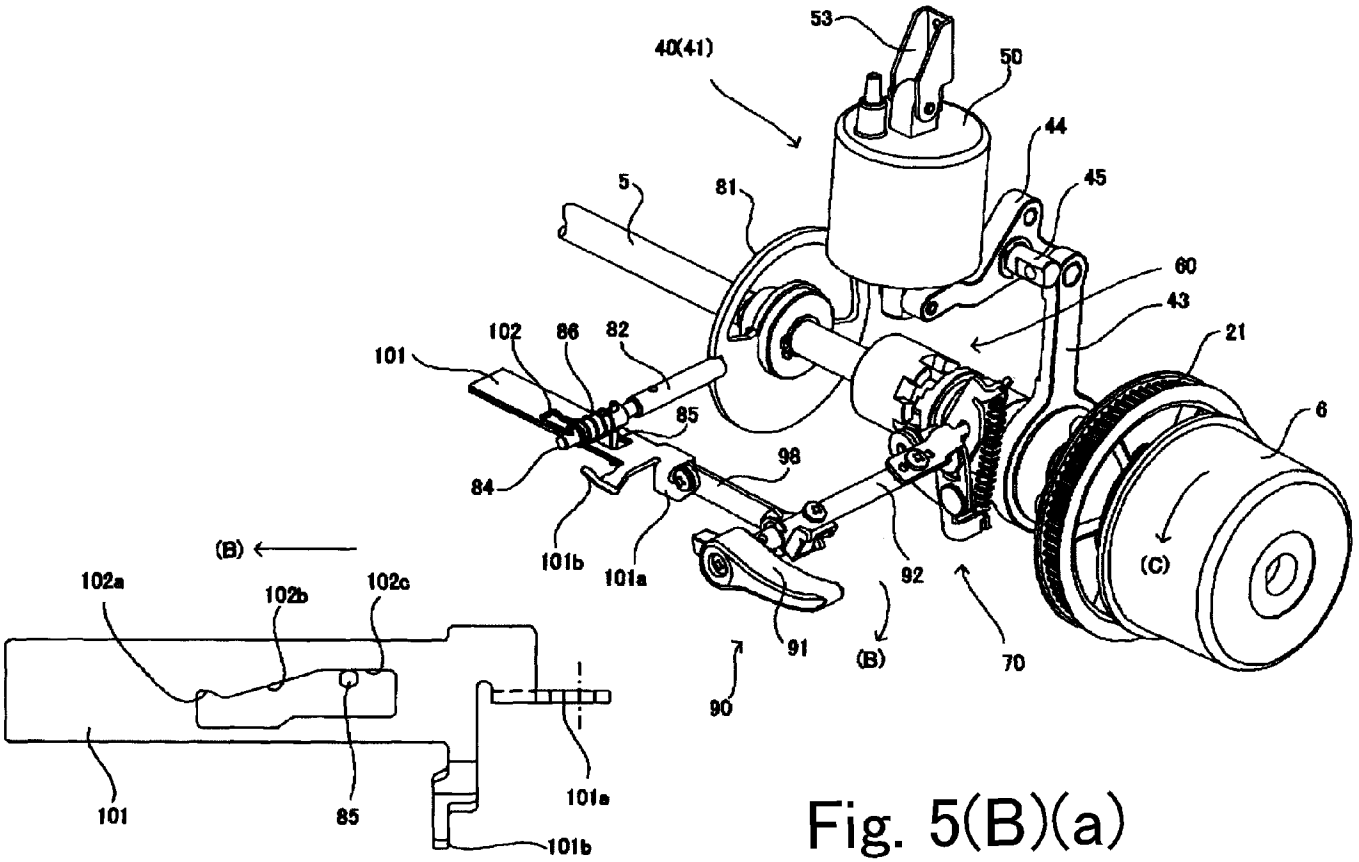
Figure 5C:
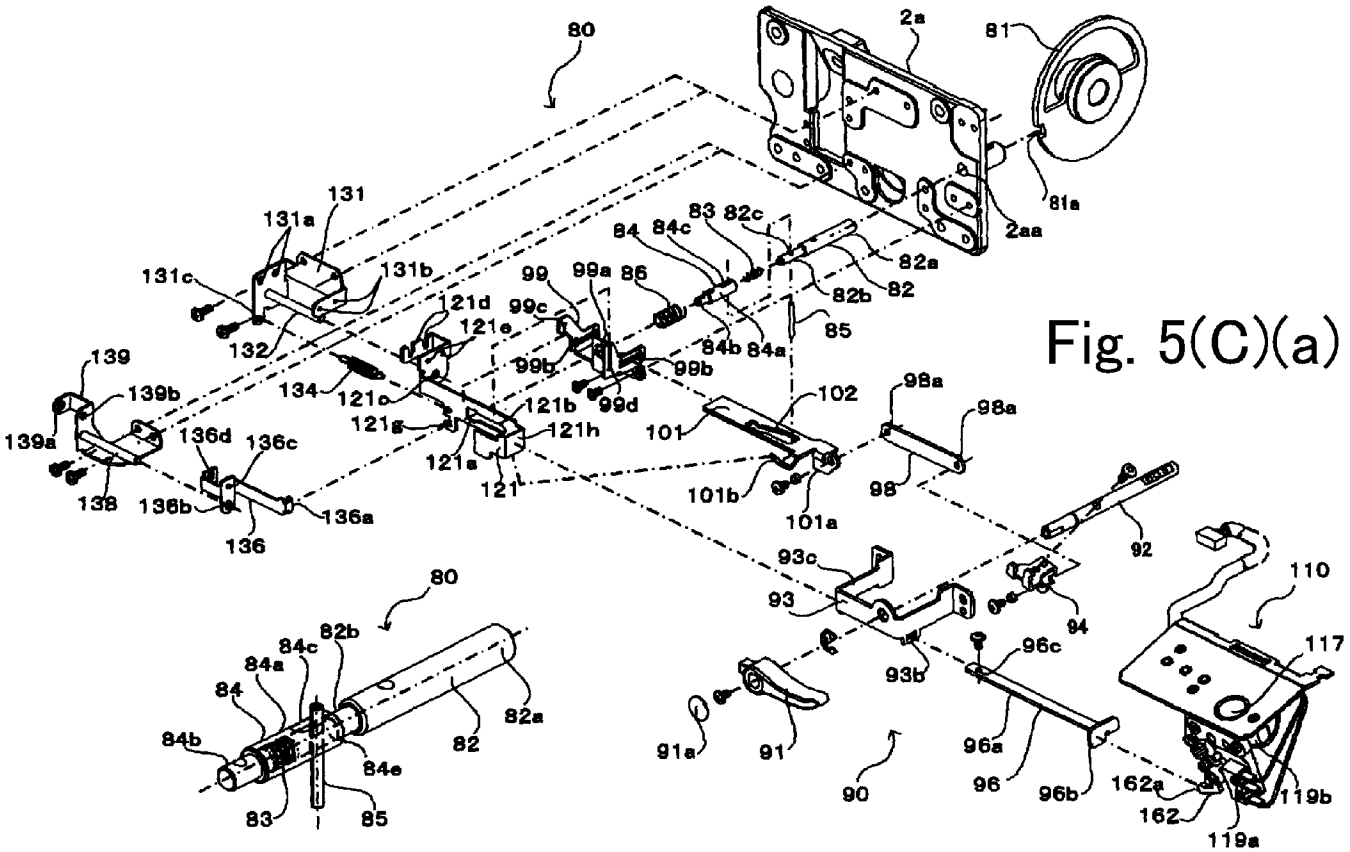

As shown in FIG. 4 (*a*), (*b*), FIG. 5 (A) (a), (b)-FIG. 5 (C) (a), (b), the 3 needles 6 threads hemstitch overlook machine 1 has the looper threading/stitch forming changeover mechanism 90 which changes over the engaging clutch 60 so as to transmit the power to the drive shaft 5 and the gas supply pump 41 respectively at the time of the stitch formation and at the time of the looper threading.

The looper threading/stitch forming changeover manual operating portion (looper threading/stitch forming changeover manual lever) 91 is screwed at a screw hole 92*c* by a screw 91*b* in a front-end portion of a changeover shaft 92 which is attached pivotally at a changeover bearing plate 93 which is fixed at the main frame 2. A hollow looper thread guide connecting arm 94 is provided at an intermediate portion of the changeover shaft 92, and a changeover actuator 95 which changes over the engaging clutch 60 is fixed at rear-end portion by a screw 95*b*. In addition, a cover 91*a* is provided to hide the screw 91*b*.

In the hollow looper thread guide connecting arm 94, a flat portion which is provided at the intermediate portion of the changeover shaft 92 is fitted into a insertion space portion 94*c* between a pair of protrusion 94*d*, and fixed at the changeover shaft 92 firmly by screwing a screw 92*e* into a screw hole 94*b*. The changeover bearing plate 93 is pinched and positioned between the protrusion 94*d* of the hollow looper thread guide connecting arm 94 and an E-ring 91*a* which is attached by insertion into a retaining groove 92*d* which is provided at the changeover shaft 92.

A two steady states changeover plate 70 is fixed at the main frame 2. A rocking spindle 77 is implanted to an attaching hole 71*c*, and the two steady states changeover plate 70 has the rocking spindle 77 whose tip portion is fitted into a connecting hole 92*a* which is holed at the rear-end portion of the changeover shaft 92, a changeover upper arm 74 which is pivotally attached swingably at the rear-end portion of the rocking spindle 77 and a changeover lower arm 75.

A changeover transmission plate 73 which extends to an axial line direction of the drive shaft 5 and implants the clutch changeover pin 72 which slides in a long groove 71*a* at one end 73*b* of the changeover transmission plate 73 is pivotally attached at a connecting hole 75*b* of the changeover lower arm 75 by a pin 76 in another end 73*a*.

Besides, the clutch changeover pin 72 penetrates to the long groove 71*a* of the two steady states changeover plate 70 to the direction of the drive shaft 5, and an E-ring 72*a* is fitted into a fixing groove of the clutch changeover pin 72 through a washer 72*b*, and thereby the clutch changeover pin 72 is pivotally attached slidably.

Although the changeover transmission plate 73 which implants the clutch changeover pin 72 is driven with an arc shape depending on the rock of the changeover lower arm 75, the clutch changeover pin 72 slides linearly to the direction of the shaft line of the drive shaft 5 in the long groove 71*a* that the clutch changeover pin 72 is penetrated.

A tip 95*a* of the changeover actuator 95 penetrates to a connecting hole 74*a* which is holed at the changeover upper arm 74, and reaches to an arc-shaped through hole 71*b* of the two steady states changeover plate 70. A tension spring 78 is stretched between a spring stud 74*c* of the changeover upper arm 74 and a spring stud 75*c* of the changeover lower arm 75.

Here, when rotating the looper threading/stitch forming changeover manual operating portion (looper threading/stitch forming changeover manual lever) 91 to a clockwise direction 3 (looper threading side), according to the changeover shaft 92, therefore according to the changeover actuator 95, the changeover upper arm 74 is rocked to the clockwise direction, and the changeover upper arm 74 and the changeover lower arm 75 are displaced rapidly in a doglegged shape by the tension spring 78 at the time that the changeover upper arm 74 and the changeover lower arm 75 pass through an equilibrium point that they form a straight line, and the clutch changeover pin 72 slides to the right end of the axial line direction of the drive shaft 5 in a control groove 62*a* of the changeover slide sleeve 62 which is fitted through the changeover transmission plate 73, and the gas supply drive member 61 and the changeover slide sleeve 62 are connected with the engaging and biting claws 61*a*, 62*c*, thereby they engage and bite mutually. The gas supply pump 41 can be driven and the looper threading can be performed by the pump drive rod 43 with the pump drive (eccentric) cam 61*b* (FIG. 3 (B), FIG. 5 (B), FIG. 8 (B)). Besides, a looper threading preparatory state of this engaging clutch 60 is retained, and the transition to the stitch forming state from the looper threading state during the gas supply operation of the gas supply pump 41 can be avoided even by any manual operation of the looper threading/stitch forming changeover manual operating portion.

On the other hand, when rotating and returning the looper threading/stitch forming changeover manual operating portion (looper threading/stitch forming changeover manual lever) 91 to the counterclockwise direction A (stitch formation side), according to the changeover shaft 92, therefore according to the changeover actuator 95, the changeover upper arm 74 is rocked to the counterclockwise direction, and the changeover upper arm 74 and the changeover lower arm 75 are displaced rapidly in an inverted doglegged shape by the tension spring 78 at the time that the changeover upper arm 74 and the changeover lower arm 75 pass through the equilibrium point that they form the straight line, and the clutch changeover pin 72 slides to the left end of the axial line direction of the drive shaft 5 in the control groove 62*a* of the changeover slide sleeve 62 which is fitted through the changeover transmission plate 73, the changeover slide sleeve 62 and the stitch forming drive member 64 are connected with the engaging claws 62*d*, 64*a*, thereby they engage mutually. The power is transmitted to the clutch hollow shaft 22 from the sewing machine motor M, and the power is transmitted to the stitch forming drive member 64 through the engaging claw 62*d* of the changeover slide sleeve 62 and the engaging claw 64*a* of the stitch forming drive member 64, and the upper shaft 5*a* can be rotated together with the drive shaft 5, and the stitch forming device 30 is operated and the stitch formation can be performed (FIG. 3 (A), FIG. 5 (A), FIG. 8 (A)). Besides, a stitch forming preparatory state of this clutch is retained.

On the other hand, the looper thread guide outlets 7*d*, 8*d*, 9*d* and the looper thread inlets 7*a*, 8*a*, 9*a* of the hollow looper thread guide 130 are disposed at the time of the looper threading and at the time of the sewing by the sewing machine so that approach/separation becomes free respectively. That is, as shown in FIG. 1, FIG. 2, FIG. 3 (C) and FIG. 5 (A)-FIG. 5 (B), the 3 needles 6 threads hemstitch overlook machine 1 has the threading connecting device 120 which is arranged so that approach/separation of the looper thread guide outlets 7*d*, 8*d*, 9*d* and the looper thread inlets 7*a*, 8*a*, 9*a* becomes free respectively at the time of the looper threading and at the time of the stitch formation depending on the manual operation of the looper threading/stitch forming changeover manual operating portion 91.

A hemstitch looper thread guide connecting plate 121 and a double chain stitch looper thread guide connecting plate 136, a hemstitch looper thread guide outlet support 131 and a double chain stitch looper thread guide outlet support 139, and a hemstitch looper take-up lever thread guide 133 and looper thread guide supports 135, 141 are provided in the threading connecting device 120. The hemstitch looper thread guide outlet support 131 and the double chain stitch looper thread guide outlet support 139, and a hemstitch looper take-up lever thread guide 133 and looper thread guide supports 135, 141 are fixed firmly at the sub frame 2*a* by screws 131*d*, 138*a*, 133*b*, 135*b* and 141*b*.

In the inside of a right end 121*i* of the hemstitch looper thread guide connecting plate 121 of the threading connecting device 120, a connecting operating lever 101*b* of a control groove cam plate 101 is arranged so that the connecting operating lever 101*b* of the control groove cam plate 101 engages and moves depending on the operation of the looper threading/stitch forming changeover manual operating portion (looper threading/stitch forming changeover manual lever) 91 through a link 98 from the hollow looper thread guide connecting arm 94 (FIG. 4, FIG. 5 (C)) which is provided at the changeover shaft 92.

A screw hole 94*a* and a screw hole 98*a* of the pulley side of the link 98 are screwed by a screw 94*e*, thereby the hollow looper thread guide connecting arm 94 is connected with the link 98. A screw hole 98*a* of the looper side and a screw hole 101*c* of the control groove cam plate 101 are screwed by a screw 101*d*, thereby the link 98 is connected with the control groove cam plate 101.

In the looper threading/stitch forming changeover mechanism 90, a square hole 93*b* of a leg portion 93*c* of the changeover bearing plate 93 which is fixed at the main frame 2 supports a switch connecting plate 96 slidably parallel to a drive shaft direction. A positioning screw is screwed at a left end of the switch connecting plate 96, and a right end has an end face 96*b* which engages to the changeover switch arm 162 (FIG. 5 (C), FIG. 10) and the switch connecting plate 96 is pressed by a changeover switch arm tip 162*a* which is repelled elastically by the tension spring 163, and slides to the looper side, and the left end of the switch connecting plate 96 engages to a right end 121*h* of the looper thread guide connecting plate 121.

In the threading connecting device 120, connecting plate guide bars 132, 138 which support the hemstitch looper thread guide connecting plate 121 and the double chain stitch looper thread guide connecting plate 136 are provided at the hemstitch looper thread guide outlet support 131 and the double chain stitch looper thread guide outlet support 139.

The hemstitch looper thread guide connecting plate 121 supports pivotally a sliding hole 121*c* which is provided at a left end, the connecting plate guide bar 132 which is implanted at the hemstitch looper thread guide outlet support 131 and both sides of a shaft hole 121*a* and an elongate hole 121*b* of a central part by sliding grooves 99*c*, 99*d* of a thread guide connecting bearing plate 99, and is supported slidably to the drive shaft direction. Besides, the connecting plate guide bar 138 which is implanted at the double chain stitch looper thread guide outlet support 139 fits into a sliding hole 136*b* of the double chain stitch looper thread guide connecting plate 136, and a connecting end 136*a* of a right end engages to a connecting portion 121*g* of the hemstitch looper thread guide connecting plate 121, and thereby the double chain stitch looper thread guide connecting plate 136 is supported slidably to the drive shaft direction in conjunction with the slide of the hemstitch looper thread guide connecting plate 121.

Besides, a square hole 99*b* is provided at the thread guide connecting bearing plate 99, and the control groove cam plate 101 is supported slidably to the drive shaft direction depending on the operation of the looper threading/stitch forming changeover manual operating portion (looper threading/stitch forming changeover manual lever) 91 (FIG. 3 (C), FIG. 5 (C)).

The hollow looper thread guides 7*e*, 8*e*, 9*e* of the hollow looper thread guide 130 which are connected to hollow pipes 116 of the looper thread introduction mechanism 110 (FIG. 10) by connecting tubes 143 and extend are connected to relay hollow looper thread guides 7*g*, 8*g*, 9*g* which are supported at supporting holes 141*a*, 135*a* respectively by connecting tubes 142.

The relay hollow looper thread guides 7*g*, 8*g*, 9*g* are inserted to the hollow looper thread guides 7*f*, 8*f*, 9*f* in the nested state through supporting holes 121*e*, 136*c*, spring receiving grooves 121*d*, 136*d*, supporting holes 131*a*, 139*b* and looper take-up lever thread guide holes 133*a*, 139*a* and form looper thread passes. Pressure-expanding springs 137 are provided between the supporting holes 121*e*, 136*c* and the spring receiving grooves 121*d*, 136*d*, and latched together at the spring receiving grooves 121*d*, 136*d* by fastening rings 137*a*, and repel elastically the hollow looper thread guides 7*f* 8*f*, 9*f* to the looper sides. Therefore, the hollow looper thread guides 7*f*, 8*f* 9*f* are retained slidably at the spring receiving grooves 121*d*, 136*d* and the supporting holes 131*a*, 139*b* respectively, and the looper thread guide outlets 7*d*, 8*d*, 9*d* and the looper thread inlets 7*a*, 8*a*, 9*a* of the upper looper 7, the lower looper 8 and the double chain stitch looper 9 can approach and separate.

Besides, as shown in FIG. 2, FIG. 5 (A)-FIG. 5 (C) (a), (b), the 3 needles 6 threads hemstitch overlook machine 1 has a positioning device 80.

The positioning device 80 has a stop positioning circular plate 81 which is coaxially attached at the drive shaft 5 and has a notch 81*a* at a stop position of the circumferential direction for aligning the positions of the looper thread guide outlets 7*d*, 8*d*, 9*d* and the looper thread inlets 7*a*, 8*a*, 9*a* horizontally and a positioning stopper shaft 82 and a thread guide connecting shaft 84 which connect the threading connecting device 120 which can fit to the notch 81*a* by rotating the pulley 6 manually at the time of the looper threading that the looper threading/stitch forming changeover manual operating portion (looper threading/stitch forming changeover manual lever) 91 is changed over and operated manually to the looper threading side and which is disposed so that approach/separation becomes free at the time of the looper threading and the stitch formation respectively.

The stopper shaft 82 comprises a large diameter stopper shaft portion 82*a* and a small diameter stopper shaft portion 82*b* which are formed integrally. The thread guide connecting shaft 84 comprises a large diameter thread guide connecting shaft portion 84*a* and a small diameter thread guide connecting shaft portion 84*b* which are formed integrally. A spring 83 is intervened between an end face of the small diameter stopper shaft portion 82*b* and a pivot hole 84*e* which is holed at the large diameter thread guide connecting shaft portion 84*a*. Besides, a spring 86 is fitted loosely in an elongate hole 84*c* of the large diameter thread guide connecting shaft portion 84*a*, and intervened between a control pin 85 which is implanted at a hole 82*c* of the small diameter stopper shaft portion 82*b* and protruded up and down from a shaft portion and the thread guide connecting bearing plate 99.

The gas carrying threading device of sewing machine of the present invention has the control pin 85 which is protruded at the stopper shaft 82 and the control groove cam plate 101 including a first control groove cam portion 102*a* which separates and moves the stopper shaft 82 from the stop positioning circular plate 81 by the control pin 85 at the time of stitch formation, a second control groove cam portion 102*c* which moves the stopper shaft 82 toward the stop positioning circular plate 81 by the control pin 85 at the time of looper threading and an intermediate control groove cam portion 102*b* which returns to the first control groove cam portion 102*a* from the second control groove cant portion 102*c*.

One end 101*a* of the control groove cam plate 101 is connected through the link 98 from the hollow looper thread guide connecting arm 94 (FIG. 4) which is provided at the changeover shaft 92, and arranged so that it moves depending on the operation of the looper threading/stitch forming changeover manual operating portion (looper threading/stitch forming changeover manual lever) 91.

In the operation of the gas carrying threading device of sewing machine which is composed in this way, when performing the looper threading, when rotating the looper threading/stitch forming changeover manual operating portion (looper threading/stitch forming changeover manual lever) 91 of the looper threading/stitch forming changeover mechanism 90 to a clockwise direction B (looper threading side) (FIG. 3 (B), FIG. 4 (*a*) (*b*), FIG. 5 (B), FIG. 7 (A), FIG. 7 (B), FIG. 8 (B)), the control groove cam plate 101 moves to a looper direction by the changeover shaft 92, the hollow looper thread guide connecting arm 94 and the link 98, and the connecting operating lever 101*b* of the control groove cam plate 101 separates from the hemstitch looper thread guide connecting plate 121, and moves to the looper direction. The control pin 85 is positioned at the second control groove cam portion 102*c*, a tip of the stopper shaft 82 contacts to an outer circumference face of the stop positioning circular plate 81 by elastic repulsion of the spring 86 which is intervened between the control pin 85 and the thread guide connecting bearing plate 99, and the spring 83 which is inserted to the pivot hole 84*e* repels elastically the end face of the small diameter stopper shaft portion 82*b*, and thereby the thread guide connecting shaft 84 fits into the shaft hole 121*a*, and cannot fit into the elongate hole 121*b* by the elasticity of a spring 134, and latches together.

In this state, the looper thread guide outlets 7*d*, 8*d*, 9*d* and the looper thread inlets 7*a*, 8*a*, 9*a* in the threading connecting device 120 are separated.

Simultaneously, according to the changeover shaft 92, therefore according to the changeover actuator 95, the changeover upper arm 74 in the engaging clutch 60 is rocked to the clockwise direction, and the changeover upper arm 74 and the changeover lower arm 75 are displaced rapidly in a doglegged shape by the tension spring 78 at the time that the changeover upper arm 74 and the changeover lower arm 75 pass through an equilibrium point that they forma straight line, and the clutch changeover pin 72 slides to the right end of the axial line direction of the drive shaft 5 in a control groove 62*a* of the changeover slide sleeve 62 which is fitted through the changeover transmission plate 73, and the gas supply drive member 61 and the changeover slide sleeve 62 are connected with the engaging and biting claws 61*a*, 62*c*, thereby they engage and bite mutually. The gas supply pump 41 can be driven and the looper threading can be performed by pump drive rod 43 with the pump drive (eccentric) cam 61*b*.

In this way, the threading connecting device 120 and the engaging clutch 60 become the looper threading preparatory state.

In such state where the changeover of the engaging clutch 60 and the connection of the threading connecting device 120 are prepared, when rotating the pulley 6 which is fastened at one end of the drive shaft 5 manually, the positioning pin 82 of the positioning device 80 is fitted into the notch 81*a* of the positioning circular plate 81 of the positioning device 80 horizontally at the stop position of the circumferential direction for aligning the positions of the looper thread guide outlets 7*d*, 8*d*, 9*d*, the looper thread inlets 7*a*, 8*a*, 9*a* and thread take-up lever holes 13*a*, 13*b*, 14*a* of looper take-up levers 13, 14, and the rotation of the drive shaft 5 is locked at this aligning position by the positioning pin 82 (FIG. 5 (B), FIG. 6 (B), FIG. 8 (B)).

Besides, the positioning pin 82 is fitted into the notch 81*a* of the positioning circular plate 81, and thereby the threading connecting device 120 operates, and the large diameter thread guide connecting shaft portion 84*a* of the positioning pin 82 disengages from the shaft hole 121*a* of the looper thread guide connecting plate 121, and the looper thread guide connecting plate 121 is elastically repelled to the looper side by the elasticity of the spring 134, and the elongate hole 121*b* of the looper thread guide connecting plates 121 slides on the small diameter thread guide connecting shaft portion 84*b*. In this case, the small diameter thread guide connecting shaft portion 84*b* is fitted into the elongate hole 121*b* by the positioning pin back spring 83.

On the other hand, by the elasticity of the spring 134, the looper thread guide connecting plates 121, 136, therefore, the hollow looper thread guides 7*f*, 8*f*, 9*f* which are connected with nested state with the hollow looper thread guides 7*e*, 8*e*, 9*e* of the hollow looper thread guide 130 move to the sides of the upper looper 7, the lower looper 8 and the double chain stitch looper 9 through the supporting holes 131*a*, 139*a* and the take-up lever thread guides 133*a*, 139*b*, and the looper thread guide outlets 7*d*, 8*d*, 9*d* and the looper thread inlets 7*a*, 8*a*, 9*a* are connected through the thread take-up lever holes 13*a*, 13*b*, 14*a* of the looper take-up levers 13, 14 which are intervened between them. In this case, the spring 137 buffers the impact when the looper thread guide outlets 7*d*, 8*d*, 9*d* of the hollow looper thread guides 7*f*, 8*f*, 9*f* and the looper thread inlets 7*a*, 8*a*, 9*a* of the upper looper 7, the lower looper 8 and the double chain stitch looper 9 are connected.

Thereby, the hollow looper thread guide 130 of the threading connecting device 120 becomes the connecting state from the connecting preparatory state (FIG. 3 (B)).

Besides, at this time, when the looper thread guide connecting plate 121 moves to the looper side, the switch connecting plate 96 which is supported slidably at the changeover bearing plate 93 is pressed by the changeover switch arm tip 162*a* which is repelled elastically by the tension spring 163, and moves to the looper side. The changeover switch arm 162 which is repelled elastically by the tension spring 163 rocks, and the changeover switch arm cam 162*c* does not press the looper threading/stitch forming changeover switch 119*a*, and the looper threading/stitch forming changeover switch 119*a* becomes an open state, and the threading button 117 becomes a standby state of the push through a motor control-looper threading/stitch forming changeover control base 119.

In the connecting state of the threading connecting device 120, when inserting each necessary looper thread to the wide-mouthed looper thread insertion slot 113*a*, 113*b*, 113*c* of the looper thread introduction mechanism 110 for about 5-6 mm (¼ inch) (FIG. 1, FIG. 3, FIG. 9) and pushing the threading button 117 which is connected to the threading switch 119*b* of the looper thread introduction pedestal 112, the threading switch 119*b* becomes the open state through the motor control-looper threading/stitch forming changeover control base 119, and the sewing machine mo tor M is controlled with the rotation of the constant speed, and the piston 48 of the gas supply pump 41 can be reciprocated by the drive shaft pulley 21 with the timing belt MB, a drive shaft pulley boss 22, the gas supply drive member 61 from the clutch hollow shaft 22 of the engaging clutch 60, the pump drive cam 61*b*, the pump drive rod 43 and the pump drive arm 44 (FIG. 7, FIG. 8, FIG. 9 (*b*)). In the operation of the gas supply pump 41, concerning the forward process of the piston 48, the piston cap 49 is connected to the inner wall surface of the pump cylinder 50 in the airtight state, and the air is compressed, and pressurized and injected as the compressed air from the delivery port 50*b* to the air inlet 112*a* (FIG. 6, FIG. 8) of the looper thread introduction mechanism 110 through the pipe 54. On the other hand, in the return (inhalation) process of the piston 48, because the piston cap 49 is not connected to the inner wall surface of the pump cylinder 50 in the airtight state and becomes open state, the air is inhaled through the outer circumference of the piston 48 and the piston cap 49, and the back flow of the air which is sent from the delivery port 50*b* is prevented by the back flow stopper ball 51*a* of the back flow stopper valve 51.

The compressed air from the gas supply pump 41 is pressurized and injected from the delivery port 50*b* to the air inlet 112*a* (FIG. 10) of the looper thread introduction mechanism 110 through the pipe 54.

Each looper thread is inhaled to the looper thread introduction pipes 116 by this pressurized injection, and the gas carrying can be performed to the looper loop-taker point thread outlets 7*b*, 8*b*, 9*b* of the upper looper 7, the lower looper 8 and the double chain stitch looper 9 through the hollow looper thread guides 7*e*, 8*e*, 9*e* of the hollow looper thread guide 130, the relay hollow looper thread guides 7*g*, 8*g*, 9*g* and the looper thread guide outlets 7*d*, 8*d*, 9*d* of the hollow looper thread guides 7*f*, 8*f*, 9*f* of the threading connecting device 120.

According to the looper thread introduction mechanism 110 of the gas carrying threading device like this, in the insertion operation of the looper thread to the upper looper 7, the lower looper 8 and the double chain stitch looper 9, when inserting the upper looper thread 16*a*, the lower looper thread 16*b* and the double chain stitch looper thread 16*c* from the thread introducing part, the thread introduction of the upper looper thread 16*a*, the lower looper thread 16*b* and the double chain stitch looper thread 16*c* can be performed strongly and certainly by the looper thread introduction mechanism 110.

Besides, according to the gas carrying threading device of sewing machine of the present invention, the pressurized gas for the gas carrying of the threading of the upper looper thread 16*a*, the lower looper thread 16*b* and the double chain stitch looper thread 16*c* is produced by a gas supply pump 41 which is operated by the sewing machine motor M, and the threading of the upper looper thread 16*a*, the lower looper thread 16*b* and the double chain stitch looper thread 16*c* can be performed by one-touch operation.

Further, according to the gas carrying threading device of sewing machine of the present invention, the threading of the upper looper thread 16*a*, the lower looper thread 16*b* and the double chain stitch looper thread 16*c* can be performed in only one hand by the looper threading/stitch forming changeover mechanism 90.

Therefore, according to the gas carrying threading device of sewing machine of the present invention, by connecting the hollow thread guides 7*e*, 8*e*, 9*e*, the relay hollow looper thread guides 7*g*, 8*g*, 9*g*, 7*f*, 8*f*, 9*f* which lead from the thread outlets 7*b*, 8*b*, 9*b* of the loop-taker point of the upper looper thread 16*a*, the lower looper thread 16*b*, the double chain stitch looper thread 16*c* to the thread introducing parts which insert the threads, the complicated thread guard is unnecessary and the threading that the handleability is easy can be performed. And, there are no mistake of the threading, no protrusion of the thread in mid-process, and no entanglement of the inserted upper looper thread 16*a*, lower looper thread 16*b* and double chain stitch looper thread 16*c* with other threads. Besides, because the threads are fed by utilizing the flow of the pressurized gas which is supplied to the hollow thread guide means, the threading can be performed at once by the extremely easy operation.

Next, at the stage that the looper threading completes, in the case that the stitch formation is performed, when rotating and returning the looper threading/stitch forming changeover manual operating portion (looper threading/stitch forming changeover manual lever) 91 of the looper threading/stitch forming changeover mechanism 90 to the counterclockwise direction A (stitch formation side) (FIG. 3 (A), FIG. 5 (A)), in the positioning device 80, the control groove cam plate 101 moves to the pulley direction by the changeover shaft 92, the hollow looper thread guide connecting arm 94 and the link 98, and the connecting operating lever 101*b* of the control groove cam plate 101 engages to the looper thread guide connecting plate 121, and the looper thread guide connecting plate 121 moves to the pulley direction by resisting the elasticity of the spring 134.

Depending on the movement of the control groove cam plate 101, the control pin 85 slides along the intermediate control groove cam portion 102*b* and is returned to the first control groove cam portion 102*a* from the second control groove cam portion 102*c*. The tip of the small diameter stopper shaft portion 82*b* of the stopper shaft 82 disengages from the notch 81*a* of the stop positioning circular plate 81 by the control pin 85 by resisting the elasticity of the spring 86. The stopper shaft 82, therefore the thread guide connecting shaft 84 moves to an opposite direction of a sewing direction in that direction of the shaft line, and because the small diameter thread guide connecting shaft portion 84*b* of the thread guide connecting shaft 84 slides in the elongate hole 121*b* of the looper thread guide connecting plate 121, the large diameter thread guide connecting shaft portion 84*a* of the thread guide connecting shaft 84 fits into the shaft hole 121*a*.

The large diameter thread guide connecting shaft portion 84*a* of the thread guide connecting shaft 84 fits into the shaft hole 121*a*, and cannot fit into the elongate hole 121*b* by the elasticity of the spring 134, and latches together. In this way, the looper thread guide outlets 7*d*, 8*d*, 9*d* and the looper thread inlets 7*a*, 8*a*, 9*a* in the threading connecting device 120 separate. The looper take-up levers 13, 14 intervene in the space that the looper thread guide outlets 7*d*, 8*d*, 9*d* and the looper thread inlets 7*a*, 8*a*, 9*a* separate, and the thread take-up lever holes 13*a*, 13*b*, 14*a* form the thread passes of the looper threads 16*a*, 16*b*, 16*c*.

As described above, when rotating the looper threading/stitch forming changeover manual operating portion (looper threading/stitch forming changeover manual lever) 91 to the counterclockwise direction simultaneously, according to the changeover shaft 92, therefore according to the changeover actuator 95, the changeover upper arm 74 is rocked to the counterclockwise direction, and the changeover upper arm 74 and the changeover lower arm 75 are displaced rapidly in an inverted doglegged shape by the tension spring 78 at the time that the changeover upper arm 74 and the changeover lower arm 75 pass through the equilibrium point that they form the straight line, and the clutch changeover pin 72 slides to the left end of the axial line direction of the drive shaft 5 in the control groove 62*a* of the changeover slide sleeve 62 which is fitted through the changeover transmission plate 73.

The changeover slide sleeve 62 is connected to the stitch forming drive member 64 through the slidable rotation transmission keys 63 by the engaging claws 62*d*, 64*a*, and they engage mutually. Thereby, the changeover slide sleeve 62 is connected to the stitch forming drive member 64 which is fastened to the drive shaft 5, and the drive shaft 5 becomes rotatable and the stitch formation becomes possible (FIG. 3 (A), FIG. 5 (A), FIG. 6 (A), FIG. 8 (A)). In this case, at the time of the looper threading, in the engaging clutch 60, although the gas supply drive member 61 and the changeover slide sleeve 62 are connected by the engaging and biting claws 61*a*, 62*c* and they retain an engaging and biting state mutually, the sewing machine motor M is stopped when operating the looper threading/stitch forming changeover manual operating portion (looper threading/stitch forming changeover manual lever) 91 for performing the stitch formation. Therefore, such biting state is loosened or unfixed, and thereby the changeover to the stitch formation becomes possible. Besides, this stitch forming preparatory state of the clutch is retained.

As this result, as for the clutch changeover pin 72, the changeover slide sleeve 62 of the engaging clutch 60 slides to the stitch forming drive member 64 side, and the transmission of the power to the gas supply drive member 61 is interrupted, and the slidable rotation transmission keys 63 are connected to the semicircular grooves 62*b* of the clutch hollow shaft 22. Therefore, the power to the drive shaft 5 is transmitted, and the stitch forming device 30 can be driven (FIG. 2, FIG. 3 (A)).

Besides, at this time, when the looper thread guide connecting plate 121 moves to the pulley side, the switch connecting plate 96 which is supported slidably at the changeover bearing plate 93 is pushed and returned to the right end 121*h* of the looper thread guide connecting plate 121, and the right end 96*b* of the switch connecting plate 96 presses the changeover switch arm tip 162*a* which is repelled elastically by the tension spring 163 and moves to the pulley side. The changeover switch arm 162 which is repelled elastically by the tension spring 163 rocks, and the changeover switch arm cam 162*c* presses the looper threading/stitch forming changeover switch 119*a*, and the switch 119*a* becomes a closed state, and a motor controller (foot controller) MC becomes the controllable standby state through the motor control-looper threading/stitch forming changeover control base 119. Because the switch 119*a* becomes the closed state, electric power control to the sewing machine motor is not performed even if the threading button 117 is pushed by such as incorrect operation.

Therefore, the sewing machine motor M is rotated and controlled in a variable state through the motor controller (foot controller) MC, and the drive shaft 5 can be rotated and driven by the drive shaft pulley 21, the drive shaft pulley boss 22 and the stitch forming drive member 64 of the engaging clutch 60 with the timing belt MB from the sewing machine motor M.

The needle drive mechanism 12 of the stitch forming device 30, the cloth feed mechanism 4 and the looper drive mechanism 10 are driven by the rotation of the drive shaft 5 and the upper shaft 5*a* which is driven by synchronizing to the drive shaft 5, and the hemstitch seam and (or) the double chain stitch can be performed on the cloth 25 which is pressed on the throat plate 3 by the presser foot mechanism 19 by the needles 11*a*, 11*b*, 11*c* and the upper looper 7, the lower looper 8, the double chain stitch looper 9 that the looper threading is performed as described above.

As is clear from the above explanation, according to the gas carrying threading device of sewing machine of the present invention, the transition to the stitch forming state from the looper threading state can be avoided during the gas supply operation of the gas supply pump by any manual operation of a looper threading/stitch forming changeover manual operating portion.

Besides, according to the gas carrying threading device of sewing machine of the present invention, the looper threading can be performed by one-handed three operations which are the threading preparatory operation, the threading positioning/connecting pulley operation and the threading gas supply operation.

Therefore, according to the gas carrying threading device of sewing machine of the present invention, the transition to the stitch forming state from the looper threading state can be avoided during the gas supply operation of the gas supply pump by any manual operation of the looper threading/stitch forming changeover manual operating portion, and by connecting with the hollow looper thread guide which leads to the looper thread introduction mechanism which inserts the thread from the thread outlet of the loop-taker point of the looper, the complicated thread guard is unnecessary and the threading that the handleability is easy can be performed. And, there are no mistake of the threading, no protrusion of the looper thread in mid-process, and no entanglement of the inserted looper thread with other thread. Besides, because the looper thread is fed by utilizing the flow of the pressurized gas which is supplied to the hollow looper thread guide, the threading can be performed at once by the extremely easy operation.

INDUSTRIAL APPLICABILITY

The gas carrying threading device of sewing machine in the present invention can be applied suitably to the chain stitch sewing machine such as the serger, the double chain stitch sewing machine, or the interlock stitch sewing machine for performing the threading of the looper thread by the one-touch operation to the looper by utilizing the pressurized gas.

EXPLANATION OF THE NUMERALS

1 sewing machine (hemstitch overlook machine)
M sewing machine motor
5 drive shaft
6 pulley
7,8,9 looper (upper looper, lower looper, double chain stitch looper)
7*a*, 8*a*, 9*a* looper thread inlet
7*b*, 8*b*, 9*b* looper loop-taker point thread outlet
7*d*, 8*d*, 9*d* looper thread guide outlet
10 looper drive mechanism
13, 14 looper take-up lever
13*a*, 13*b*, 14*a* thread take-up lever hole
16*a*, 16*b*, 16*c* looper thread(upper looper thread, lower looper thread, double chain stitch looper thread)
22 clutch hollow shaft
30 stitch forming device
40 gas supply source (41 gas supply pump)
60 clutch (engaging clutch)
61 gas supply drive member
61*a*, 62*c* engaging and biting claw
62 changeover slide sleeve
62*d*, 64*a* engaging claw
63 slidable rotation transmission key
64 stitch forming drive member
70 two steady states changeover plate
80 positioning device
81*a* notch
81 stop positioning circular plate
82 stopper shaft
85 control pin
90 looper threading/stitch forming changeover mechanism
91 looper threading/stitch forming changeover manual operating portion (looper threading/stitch forming change over manual lever)
101 control groove cam plate
102*a* first control groove cam portion
102*c* second control groove cam portion
110 looper thread introduction mechanism
120 threading connecting device
130 (7*e*, 8*e*, 9*e*, 7*f*, 8*f*, 9*f*, 7*g*, 8*g*, 9*g*) hollow looper thread guide

The invention claimed is:

1. A gas carrying threading device of sewing machine comprising:

at least one looper having a hollow structure from a looper thread inlet to a looper loop-taker point thread outlet, a looper thread introduction mechanism inserting a looper thread which is led to said looper, a hollow looper thread guide extending from said looper thread introduction mechanism to said looper thread inlet and having a looper thread guide outlet, a gas supply source that a looper threading of said looper thread is performed from said looper thread introduction mechanism to said looper thread guide outlet through said hollow looper thread guide by the gas carrying, a clutch for respectively transmitting power from the sewing machine motor to a drive shaft driving a stitch forming device including said looper at the time of the stitch formation or to said gas supply source at the time of the looper threading, and a looper threading/stitch forming changeover mechanism for changing over said clutch so that the transmission of the power to said stitch forming device is interrupted and the power is transmitted to said gas supply source at the time of the looper threading and so that the power is transmitted to said stitch forming device and the transmission of the power to said gas supply source is interrupted at the time of the stitch formation depending on a manual operation of a looper threading/stitch forming changeover manual operating portion, wherein said clutch comprises an engaging clutch which is moved to one of a gas supply drive member which transmits the power to said gas supply source and a stitch forming drive member which is fastened to one end of said drive shaft and transmits the power to said stitch forming device so that approach/separation becomes free depending on a manual operation of said looper threading/stitch forming changeover manual operating portion and which transmits the power from said sewing machine motor through a clutch hollow shaft and retains the connecting state when connecting to said gas supply drive member, and at the time of said looper threading, said clutch hollow shaft is combined to a changeover slide sleeve which is changed over and slides depending on the manual operation of said looper threading/stitch forming changeover manual operating portion through a slidable rotation transmission key and connected to said gas supply drive member by an engaging and biting claw, and at the time of said stitch formation, said clutch hollow shaft is connected to said stitch forming drive member by an engaging claw through said changeover slide sleeve.

2. A gas carrying threading device of sewing machine according to claim 1, wherein:

said looper thread guide outlet and said looper thread inlet comprise a threading connecting device which is disposed so that approach/separation becomes free at the time of the looper threading and at the time of the stitch formation respectively depending on the manual operation of said looper threading/stitch forming changeover manual operating portion.

3. A gas carrying threading device of sewing machine according to claim 1, wherein:

by rotating a pulley which is fastened at one end of said drive shaft manually, when said looper thread guide outlet and said looper thread inlet are aligned horizontally, a positioning device which connects said looper thread guide outlet of said hollow looper thread guide and said looper thread inlet of said looper is provided.

4. A gas carrying threading device of sewing machine according to claim 1, wherein:

said positioning device has a stop positioning plate, which is coaxially attached at said drive shaft and has a notch at the stop position of the circumferential direction for aligning horizontally the positions of said looper thread guide outlet, a thread take-up lever hole which is formed at a looper take-up lever and said looper thread inlet, and has a stopper shaft, which is fitted to said notch by rotating said pulley manually at the time of the looper threading that said looper threading/stitch forming changeover manual operating portion is changed over manually to the looper threading side.

5. A gas carrying threading device of sewing machine according to claim 4, wherein:

a control pin which is protruded at said stopper shaft and a control groove cam plate including a first control groove cam portion which moves said stopper shaft so as to separate from said stop positioning circular plate by said control pin at the time of stitch formation and a second control groove cam portion which moves said stopper shaft toward said stop positioning circular plate by said control pin at the time of looper threading are provided.

6. A gas carrying threading device of sewing machine according to claim 1, wherein:

said changeover slide sleeve is connected to said gas supply drive member at the time of said looper threading by changing over and sliding depending on the manual operation of said looper threading/stitch forming changeover manual operating portion through a two steady states changeover plate, and is connected to said stitch forming drive member at the time of stitch formation.

7. A gas carrying threading device of sewing machine comprising:

at least one looper having a hollow structure from a looper thread inlet to a looper loop-taker point thread outlet, a looper thread introduction mechanism inserting a looper thread which is led to said looper, a hollow looper thread guide extending from said looper thread introduction mechanism to said looper thread inlet and having a looper thread guide outlet, a gas supply source that a looper threading of said looper thread is performed from said looper thread introduction mechanism to said looper thread guide outlet through said hollow looper thread guide by the gas carrying, a clutch for respectively transmitting power from the sewing machine motor to a drive shaft driving a stitch forming device including said looper at the time of the stitch formation or to said gas supply source at the time of the looper threading, and a looper threading/stitch forming changeover mechanism for changing over said clutch so that the transmission of the power to said stitch forming device is interrupted and the power is transmitted to said gas supply source at the time of the looper threading and so that the power is transmitted to said stitch forming device and the transmission of the power to said gas supply source is interrupted at the time of the stitch formation depending on a manual operation of a looper threading/stitch forming changeover manual operating portion, wherein:

said clutch comprises an engaging clutch which is moved to one of a gas supply drive member which transmits the power to said gas supply source and a stitch forming drive member which is fastened to one end of said drive shaft and transmits the power to said stitch forming device so that approach/separation becomes free depending on a manual operation of said looper threading/stitch forming changeover manual operating portion and which transmits the power from said sewing machine motor through a clutch hollow shaft and retains the connecting state when connecting to said gas supply drive member, said positioning device has a stop positioning plate, which is coaxially attached at said drive shaft and has a notch at the stop position of the circumferential direction for aligning horizontally the positions of said looper thread guide outlet, a thread take-up lever hole which is formed at a looper take-up lever and said looper thread inlet, and has a stopper shaft, which is fitted to said notch by rotating said pulley manually at the time of the looper threading that said looper threading/stitch forming changeover manual operating portion is changed over manually to the looper threading side, and a control pin which is protruded at said stopper shaft and a control groove cam plate including a first control groove cam portion which moves said stopper shaft so as to separate from said stop positioning circular plate by said control pin at the time of stitch formation and a second control groove cam portion which moves said stopper shaft toward said stop positioning circular plate by said control pin at the time of looper threading are provided.

8. A gas carrying threading device of sewing machine according to claim 7, wherein:

said looper thread guide outlet and said looper thread inlet comprise a threading connecting device which is disposed so that approach/separation becomes free at the time of the looper threading and at the time of the stitch formation respectively depending on the manual operation of said looper threading/stitch forming changeover manual operating portion.

9. A gas carrying threading device of sewing machine according to claim 7, wherein:

by rotating a pulley which is fastened at one end of said drive shaft manually, when said looper thread guide outlet and said looper thread inlet are aligned horizontally, a positioning device which connects said looper thread guide outlet of said hollow looper thread guide and said looper thread inlet of said looper is provided.

* * * * *